US008522803B2

(12) United States Patent
Shea

(10) Patent No.: US 8,522,803 B2
(45) Date of Patent: Sep. 3, 2013

(54) MATERIAL-REMOVAL SYSTEM

(76) Inventor: James P. Shea, Lake Angeles, MI (US)

( * ) Notice: Subject to any disclaimer, the term of this patent is extended or adjusted under 35 U.S.C. 154(b) by 1264 days.

(21) Appl. No.: 12/069,778

(22) Filed: Feb. 13, 2008

(65) Prior Publication Data

US 2008/0216878 A1 Sep. 11, 2008

Related U.S. Application Data

(60) Provisional application No. 60/901,186, filed on Feb. 13, 2007.

(51) Int. Cl.
*B08B 3/12* (2006.01)

(52) U.S. Cl.
USPC ..... 134/181

(58) Field of Classification Search
USPC ..... 134/198
See application file for complete search history.

(56) References Cited

U.S. PATENT DOCUMENTS 6,315,648 B1 * 11/2001 Neer ..... 451/92
6,378,163 B1 * 4/2002 Moll et al. ..... 15/322
6,752,707 B1 * 6/2004 Palushi ..... 451/350

FOREIGN PATENT DOCUMENTS

WO WO 00/20693 4/2000
WO WO 2005/071168 8/2005

* cited by examiner

*Primary Examiner* — Michael Kornakov
*Assistant Examiner* — David Cormier
(74) *Attorney, Agent, or Firm* — Brinks Hofer Gilson & Lione

(57) ABSTRACT

A material-removal system can include a spray-head assembly with a plurality of rotatable fluid bars arranged in a single shroud with overlapping sweeps. A gear-box assembly can index the rotations of the fluid bars to coordinate their rotation and prevent the fluid bars from interfering with one another. The material-removal system can be mounted on a mobile platform, such as a vehicle. The vehicle can have a fluid-storage tank and a debris tank that can be tilted for dumping operation while the fluid-storage tank remains stationary. A peristaltic pump can advantageously remove liquid waste from the debris tank while a vacuum system has the debris tank operating under vacuum. The spray-head assembly can be coupled to the vehicle with an articulating-arm assembly that can include a four-bar mechanism and a pair of rotary actuators to facilitate vertical and rotational movement of the arm assembly and the spray-head assembly.

5 Claims, 24 Drawing Sheets

MATERIAL-REMOVAL SYSTEM

FIELD

The present disclosure relates to material-removal systems and, more particularly, to material-removal systems that include a fluid-blasting, spray-head assembly.

BACKGROUND

The statements in this section merely provide background information related to the present disclosure and may not constitute prior art.

Material-removal systems can use a fluid-blasting, spray-head assembly (hereinafter referred to as "spray-head assembly") to remove material from a surface. The spray-head assembly can direct a stream of high-pressure fluid onto a surface to remove material therefrom.

The spray-head assembly typically includes individual fluid bars that each rotate about an associated pivot. Each fluid bar is spaced apart and disposed within separate shrouds or housings and rotates therein. The shroud is open on one side to allow the pressurized fluid from the fluid bar to be directed toward the working surface. Each rotating fluid bar has an effective area or sweep over which the pressurized fluid is directed. The rotation of the fluid bar results in a circular sweep with a diameter that is related to the length of the fluid bar and the distance from the surface. To increase the effective area of the spray-head assembly, the multiple fluid bars are arranged so that the sweep of the individual rotating fluid bars overlaps one another as the spray-head assembly is moved over the surface. The use of individual or separate shrouds for each fluid bar, however, can result in a large spray-head assembly. The larger the spray-head assembly is, the more difficult it can be to control the spray-head assembly and/or maneuver the spray-head assembly into confined spaces or restricted areas. Thus, it would be advantageous to provide a spray-head assembly that allows for overlapping sweeps of the spray patterns while reducing the overall size of the spray-head assembly.

SUMMARY

The present disclosure teaches a fluid-blasting, spray-head assembly that can be used to remove coatings from a surface. The fluid-blasting head can include a plurality of fluid bars that each directs a flow of pressurized fluid at a desired surface. The fluid bars can rotate about individual pivots. The fluid bars can be indexed relative to one another such that the rotation of the fluid bars is coordinated. Multiple fluid bars can be disposed within a single shroud and can have overlapping sweeps such that a sweep of one of the rotating fluid bars can overlap the sweep of one or more adjacent rotating fluid bars. The fluid bars can be aligned in a straight configuration with overlapping sweeps. A gear assembly can be coupled to each of the fluid bars to index the rotation. A drive system can drive rotation of the fluid bars. A vacuum source can be connected to the shroud to capture debris and discharged fluid.

The spray-head assembly can include a plurality of fluid bars operable to direct a flow of high-pressure fluid toward a surface. The fluid bars can be simultaneously rotatable about individual axes and can overlap one another during rotation. A drive mechanism can drive rotation of the fluid bars about the respective axes. The drive mechanism can coordinate the rotation of the fluid bars such the fluid bars do not hit during the simultaneous rotation. The overlapping of the fluid bars can advantageously provide a spray-head assembly of reduced size. The fluid bars can be enclosed within a single cavity with a shroud. A vacuum source can be coupled to the spray-head assembly to capture discharge fluid and debris generated by the fluid in a debris tank. The vacuum source can draw a flow of cooling air over the drive mechanism to cool the drive mechanism. The drive mechanism can include a plurality of fins on the exterior thereof to facilitate the removal of heat with the cooling air flow. The captured discharge fluid can be filtered and reused to supply pressurized fluid to the spray-head assembly.

The spray-head assembly can be mounted on a device or mechanism operable to move the spray-head assembly along a surface from which material is to be removed. The mechanism or device can include a robotic mechanism, a cable driven system, and a self-propelled system. The surface can be horizontal, vertical, inclined, flat, curved, undulating, irregular and the like. The device or mechanism can be mobile to allow the spray-head assembly to move along a larger surface. The mobile mechanism can be a mobile platform that travels along the surface. The mobile platform can include a high-pressure fluid supply system operable to supply high-pressure fluid to the spray-head assembly. A fluid-storage tank and the debris tank can be coupled to or separate from the mobile platform.

A recirculation system can be used with the spray-head assembly. The recirculation system can capture fluid discharged by the spray-head assembly, filter the captured fluid and reuse the filtered fluid to supply a pressurized fluid flow to the spray-head assembly.

A peristaltic pump can communicate with a debris tank. The peristaltic pump can advantageously allow the removal of fluid from the debris tank while a vacuum system is creating a vacuum within the debris tank.

The fluid flow supplied to the spray-head assembly can be heated. The heated fluid flow can advantageously allow use of the spray-head assembly in lower temperature environments.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 1:
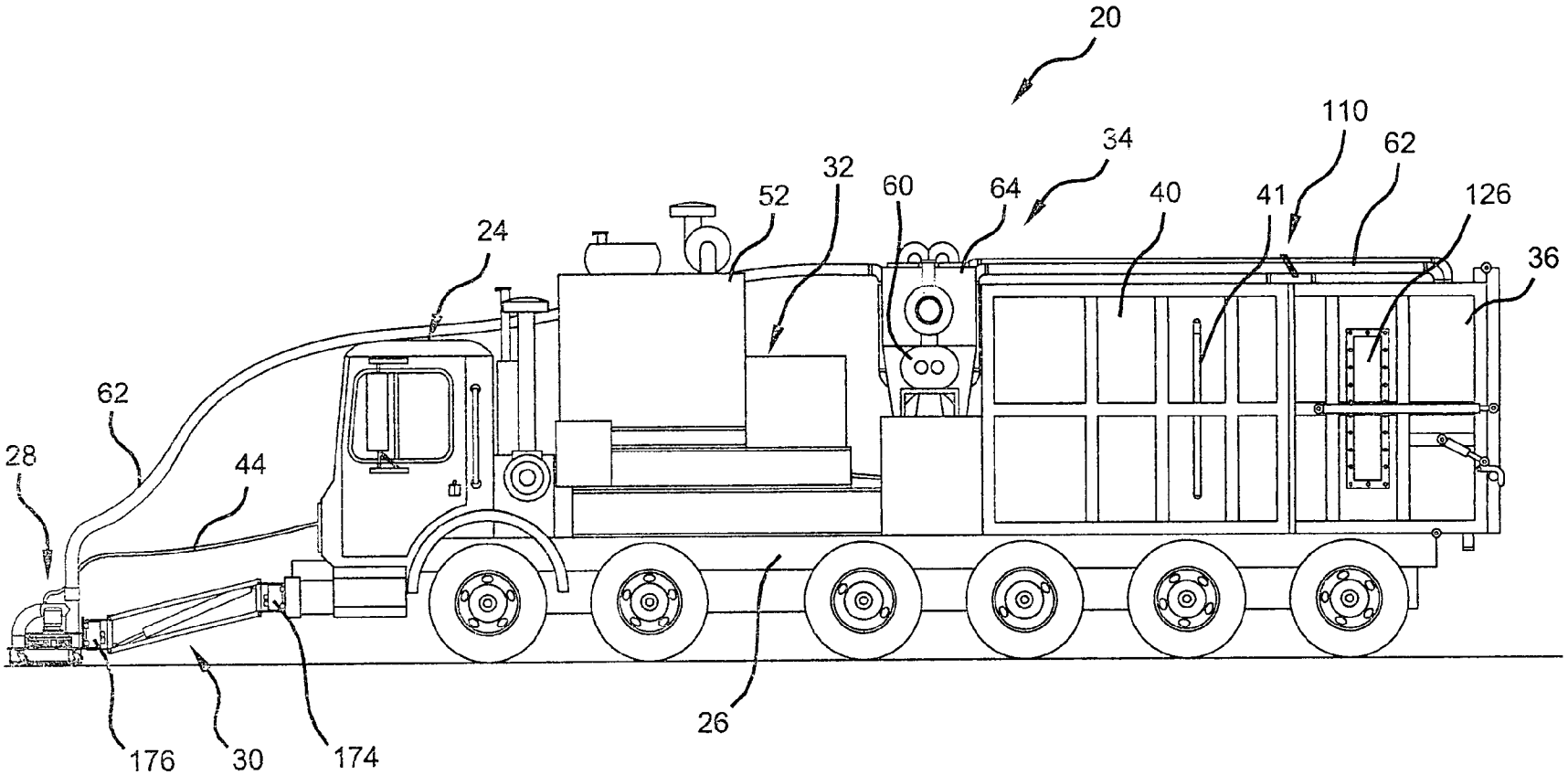
FIG. 1 is a side elevation view of an exemplary mobile platform having a material-removal system according to the present teachings.
Figure 5A:
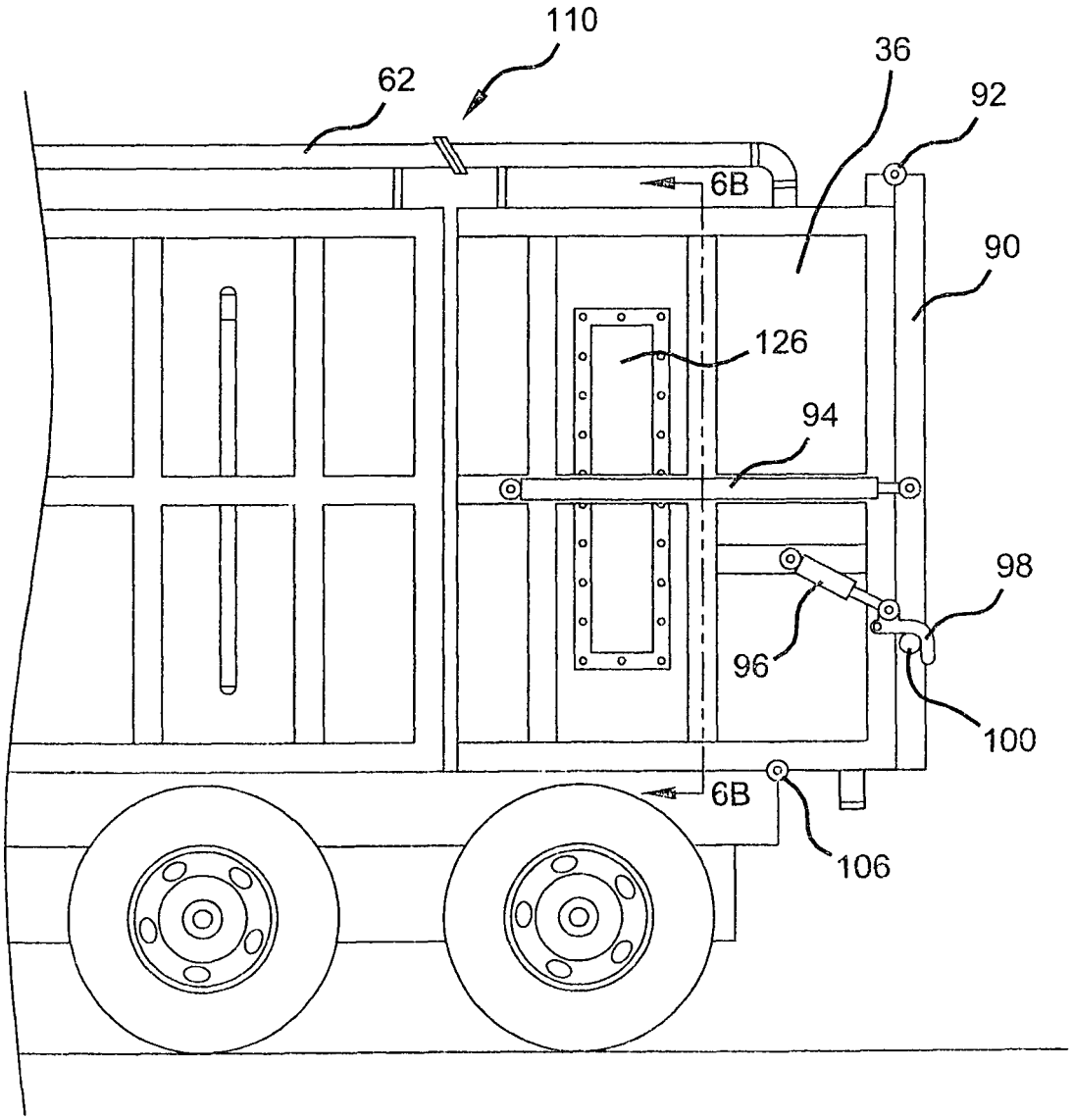
Figure 6A:
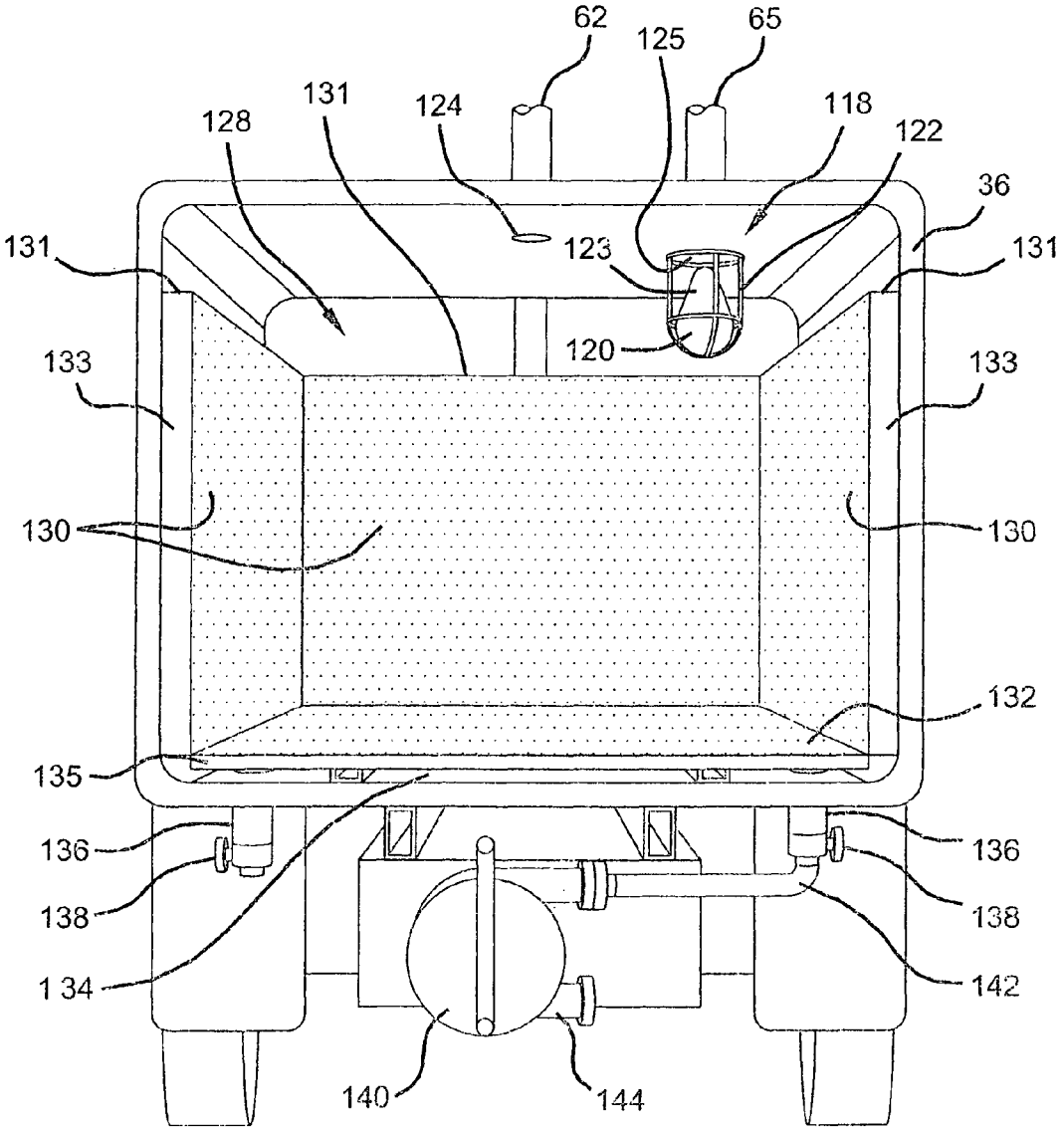
Figure 6B:
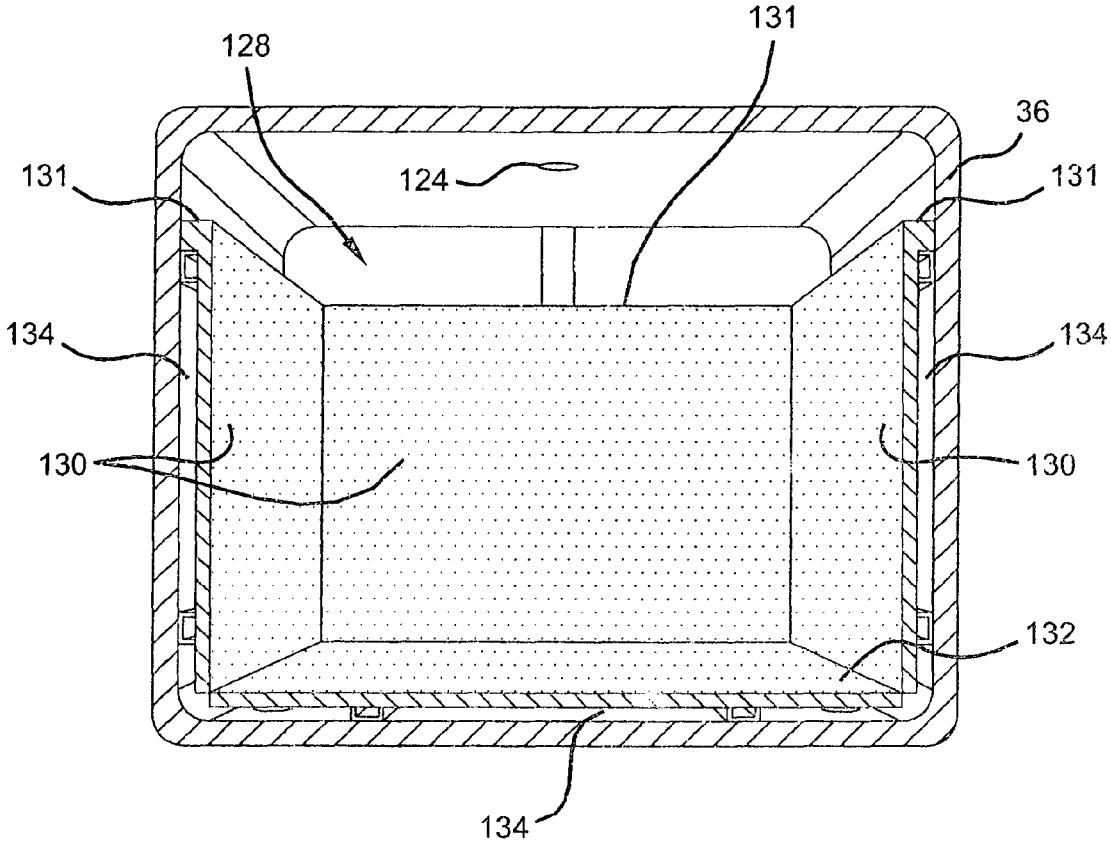
Figure 7A:
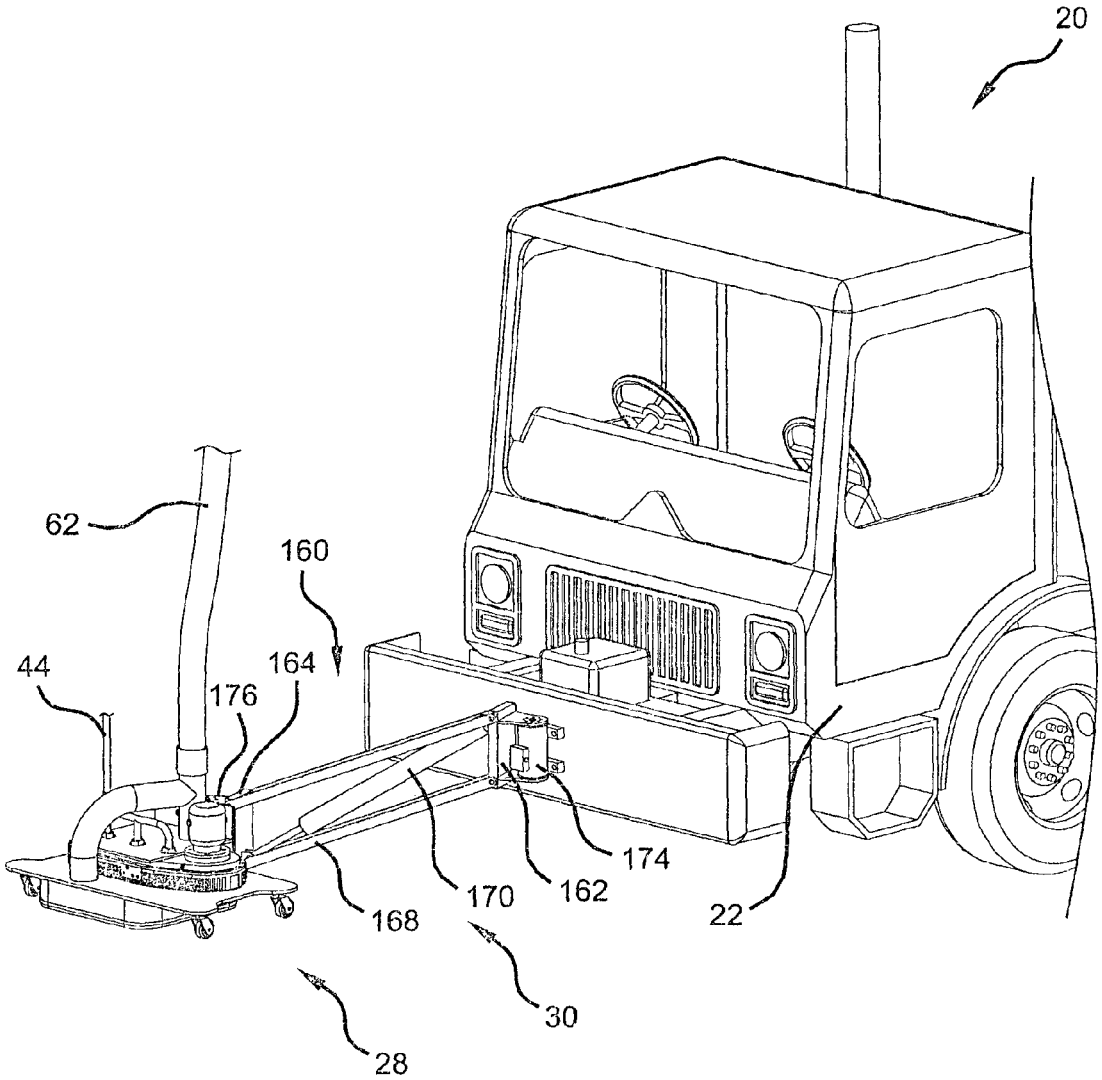
Figure 8:
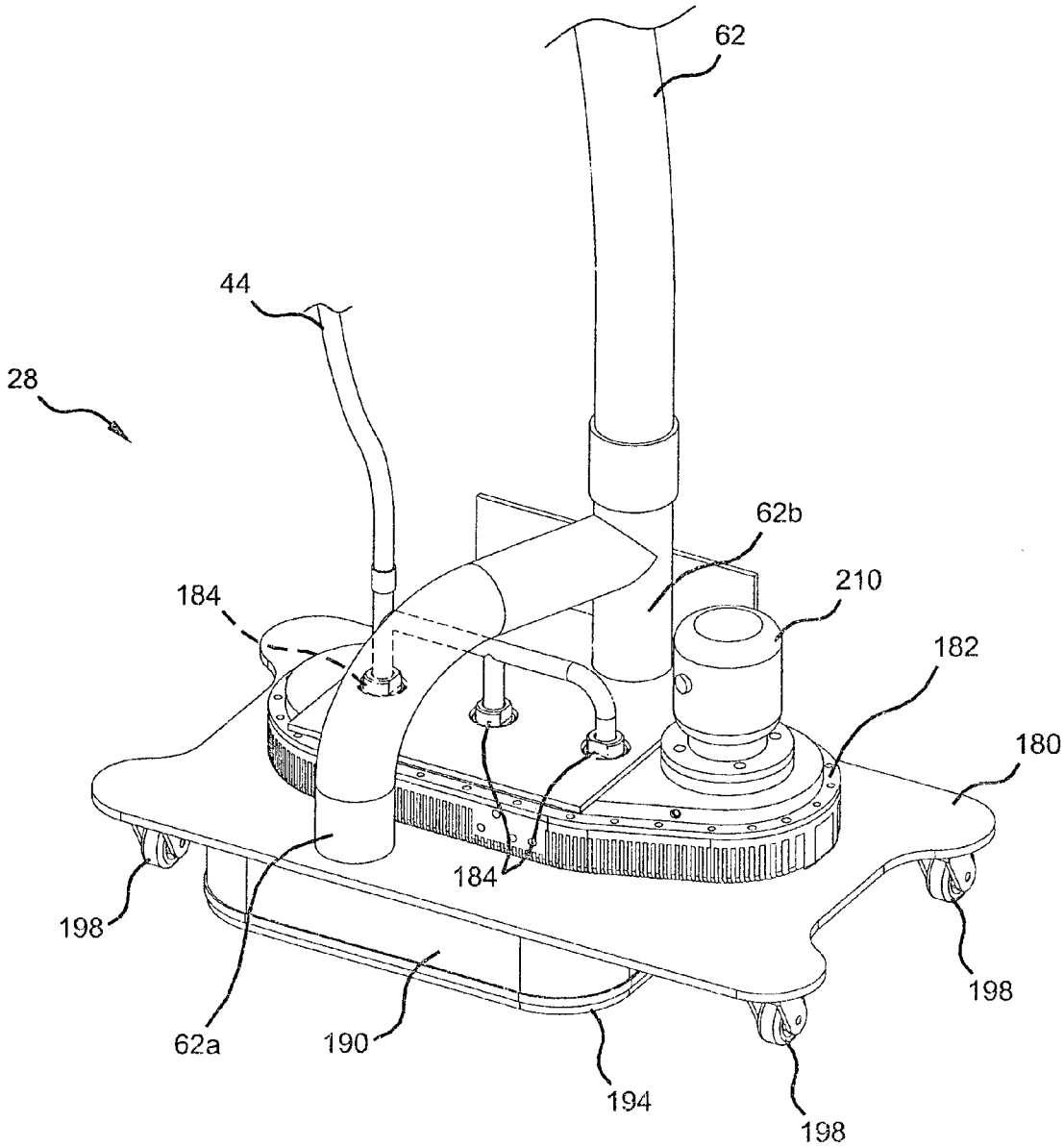
Figure 9:
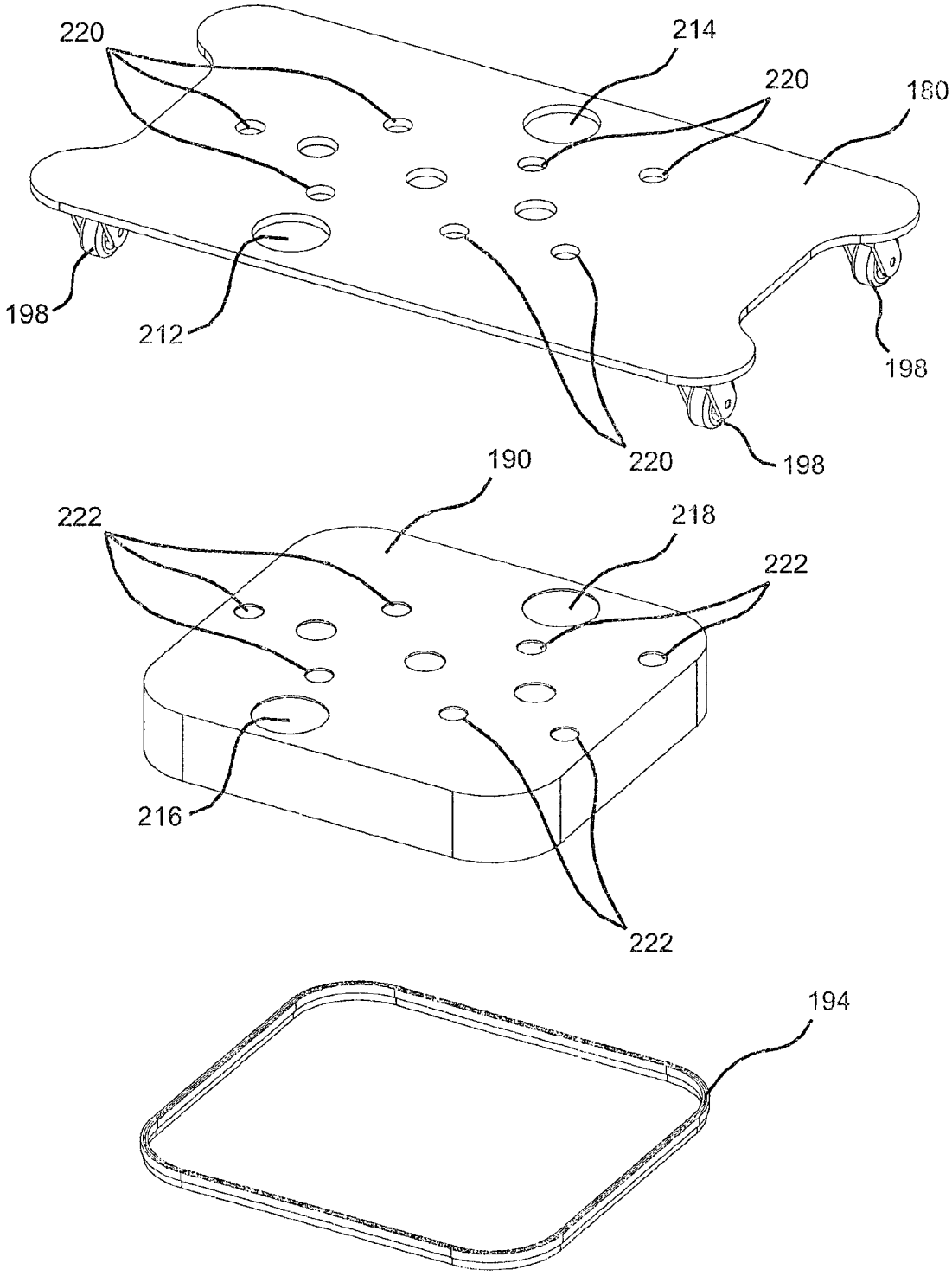
Figure 10:
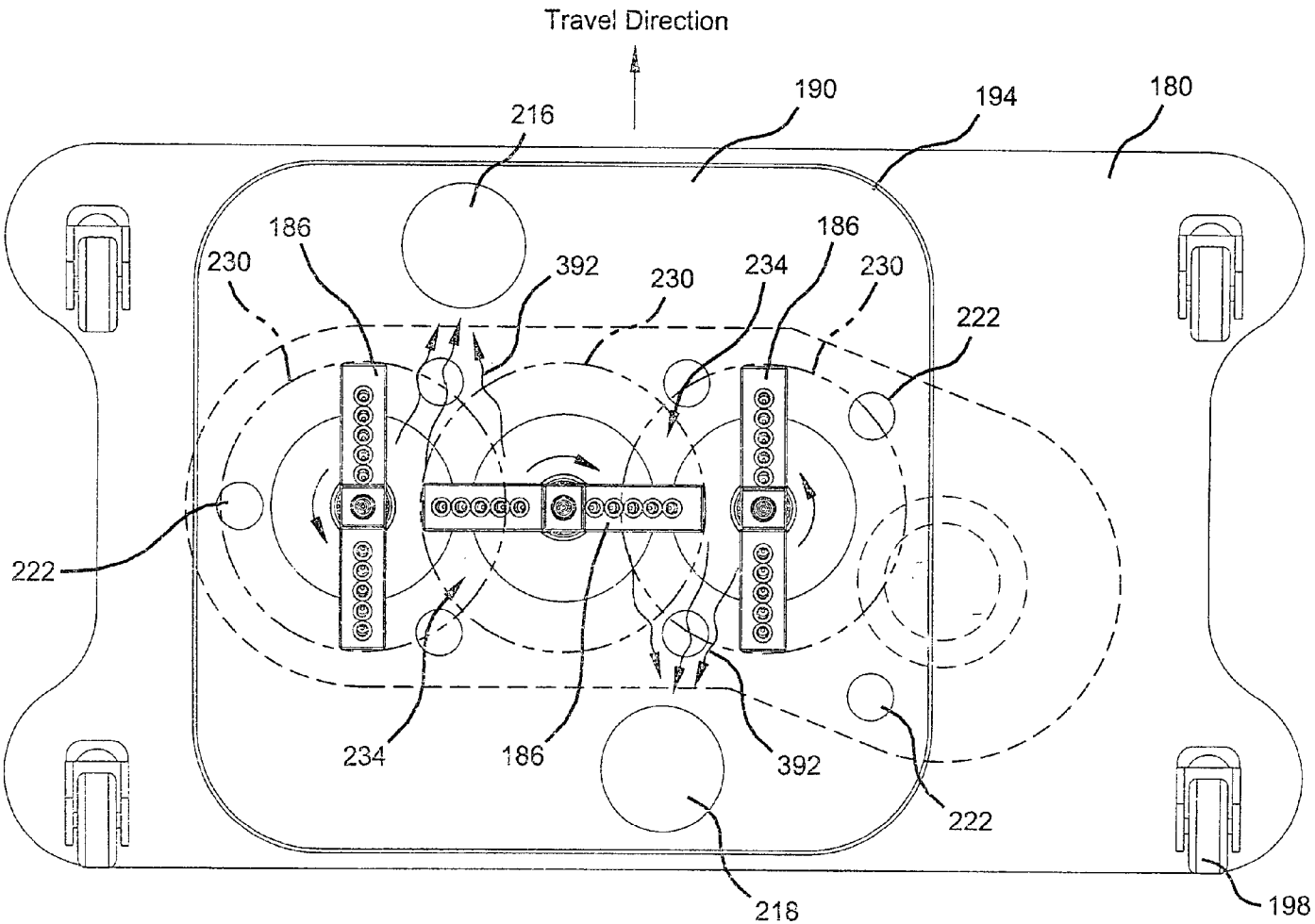
Figure 11A:
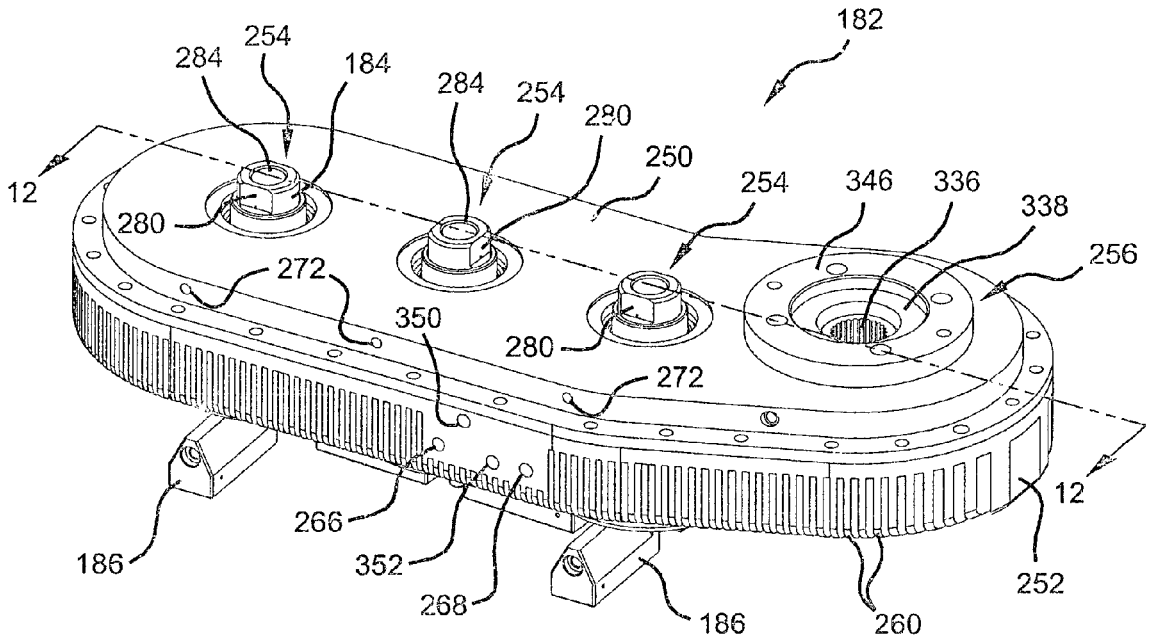
Figure 11B:
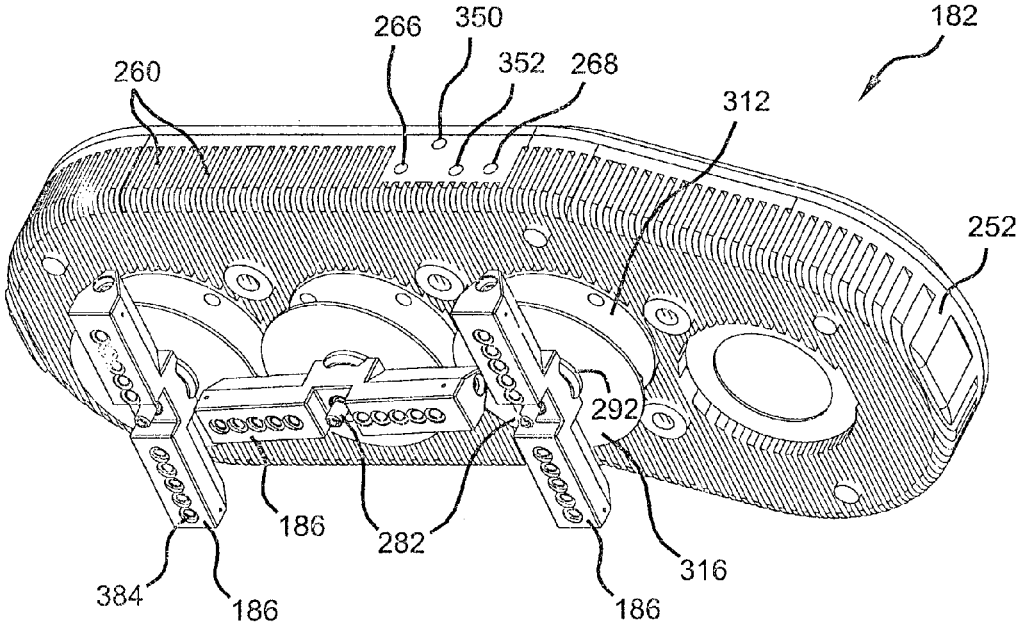
Figure 12:
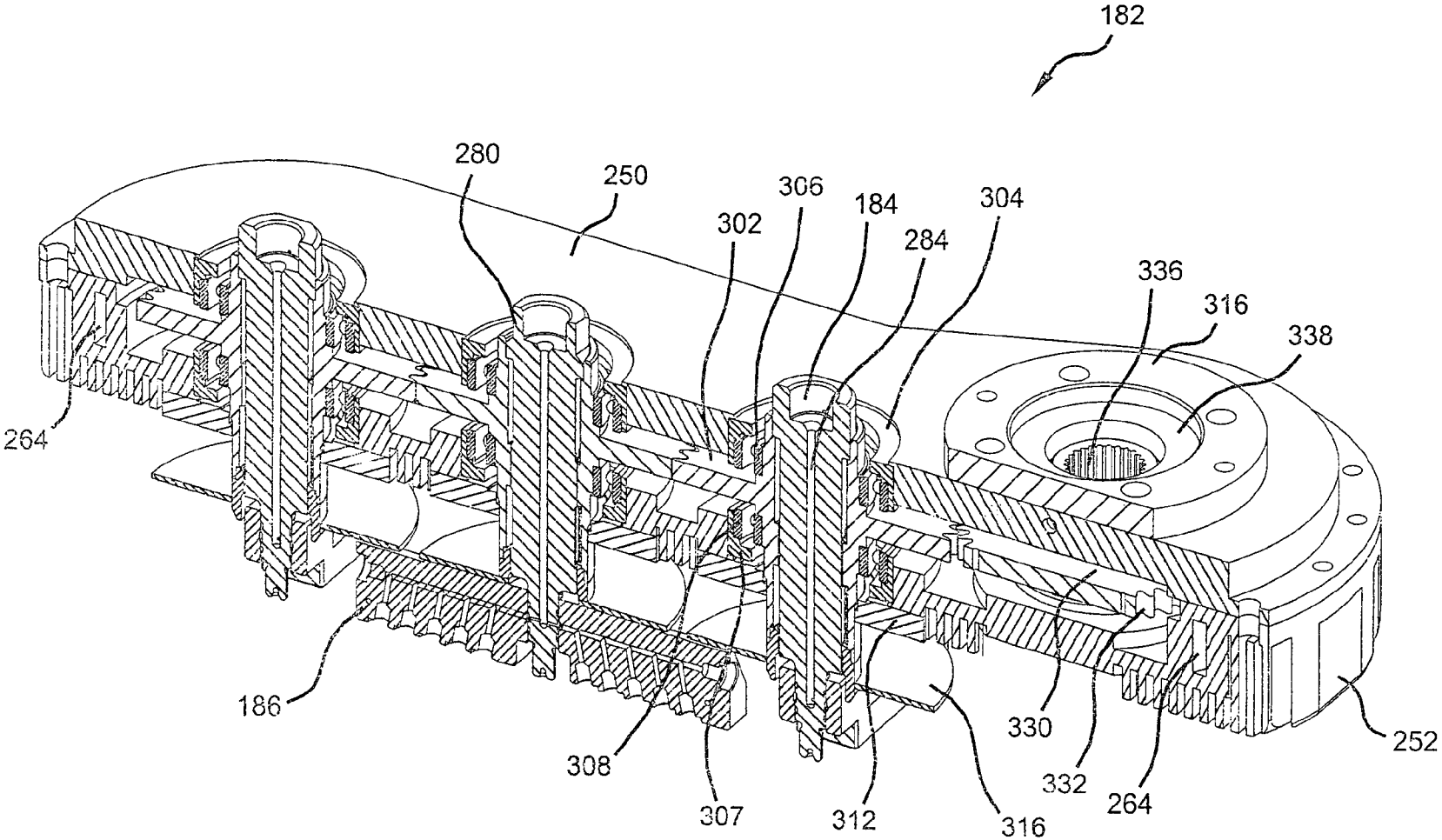
Figure 13:
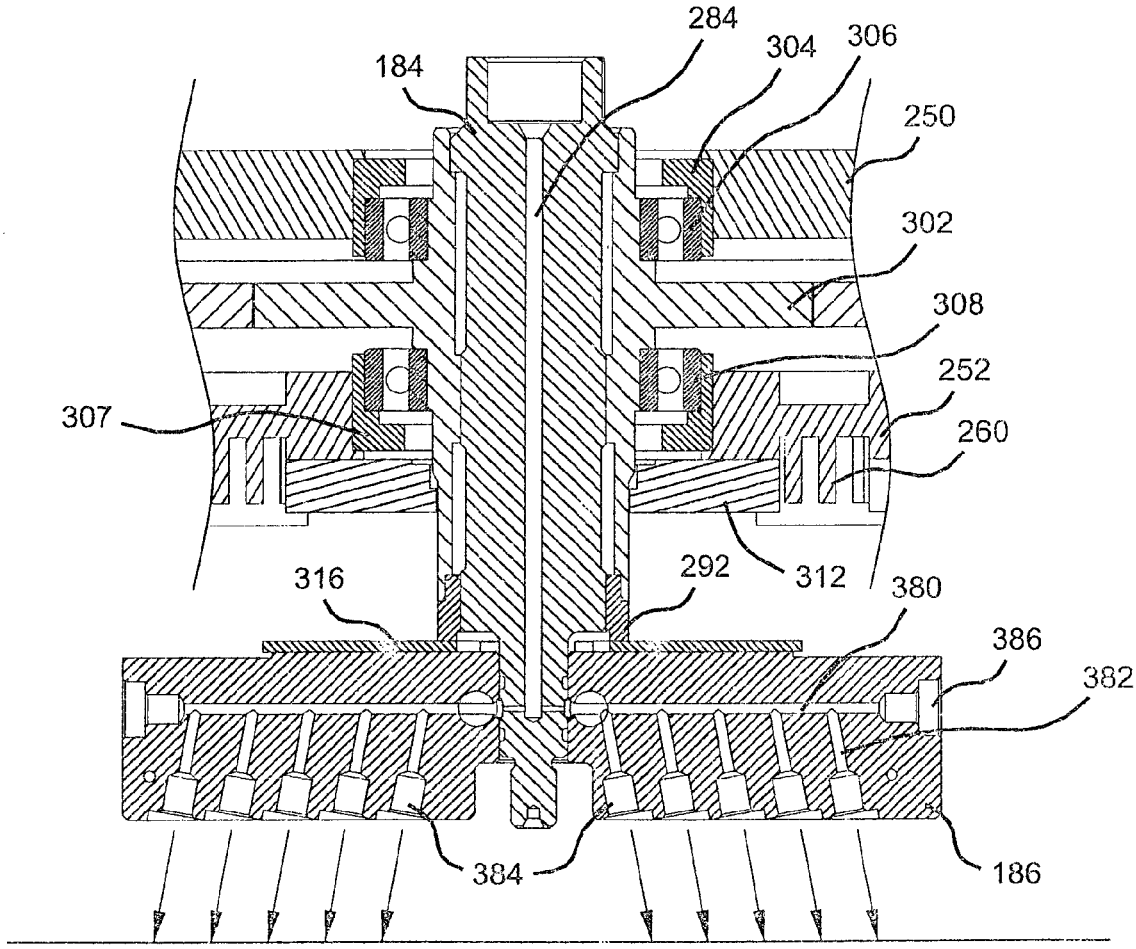
Figure 14:
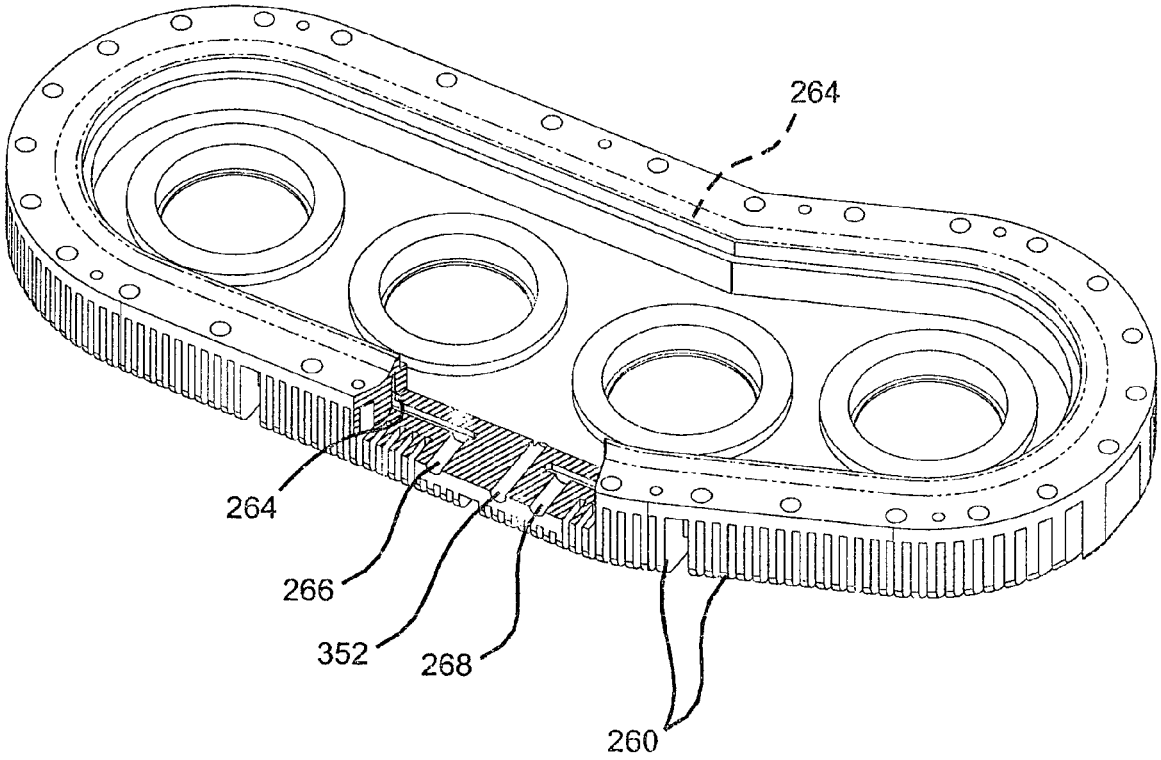
Figure 15:
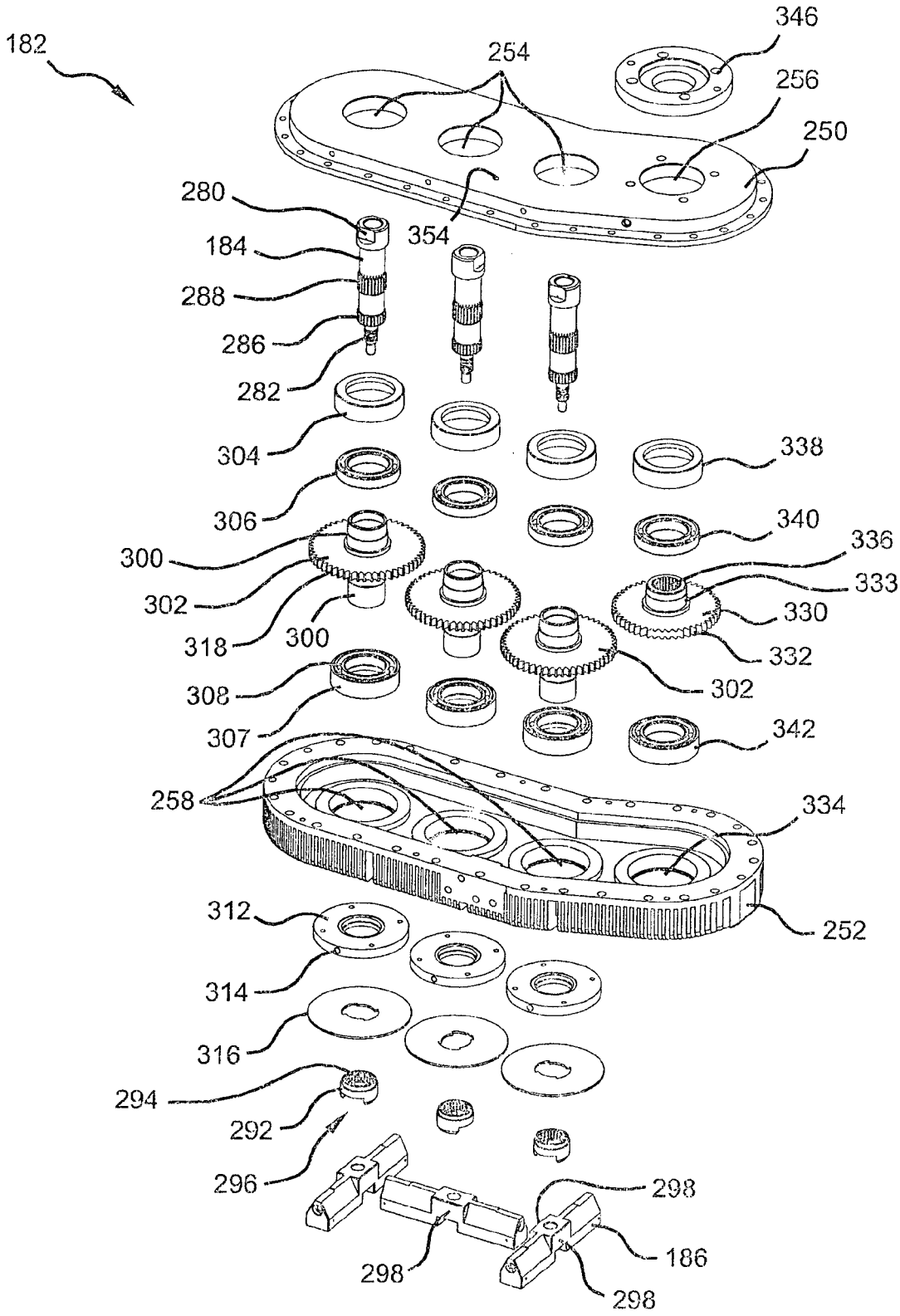
Figure 16:
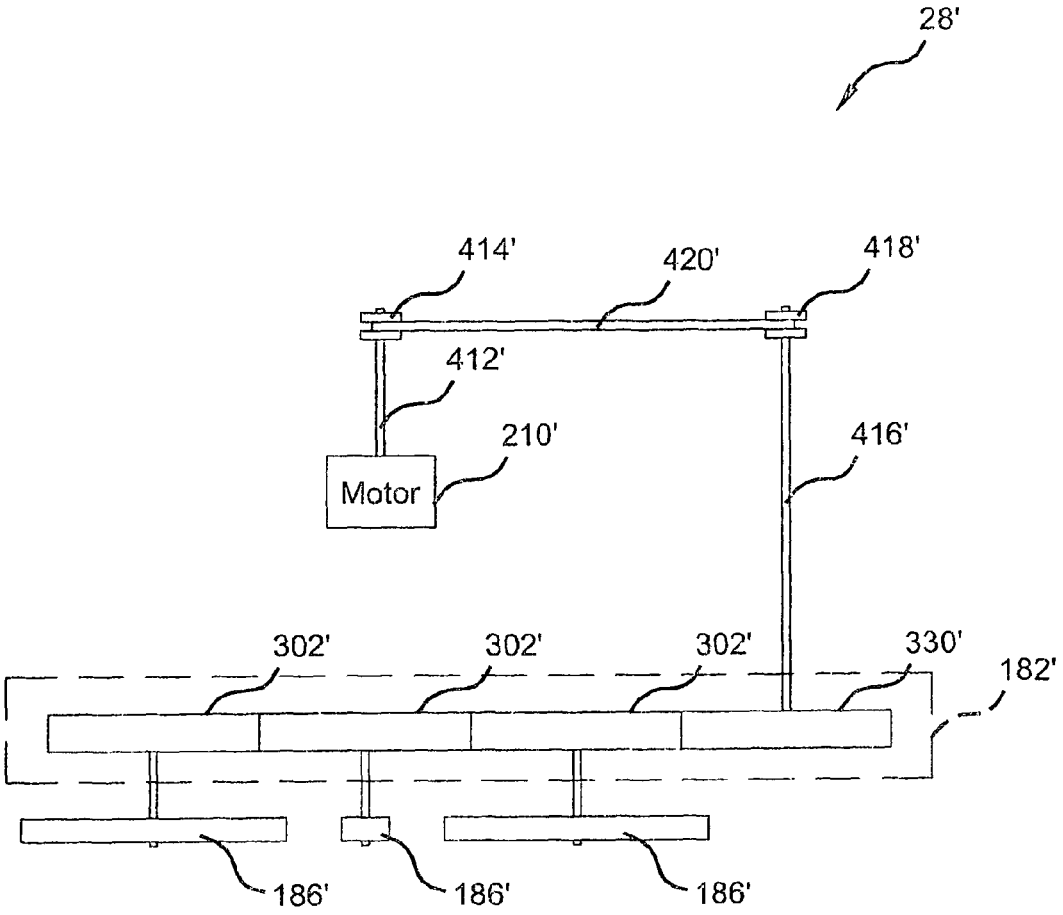
Figure 17:
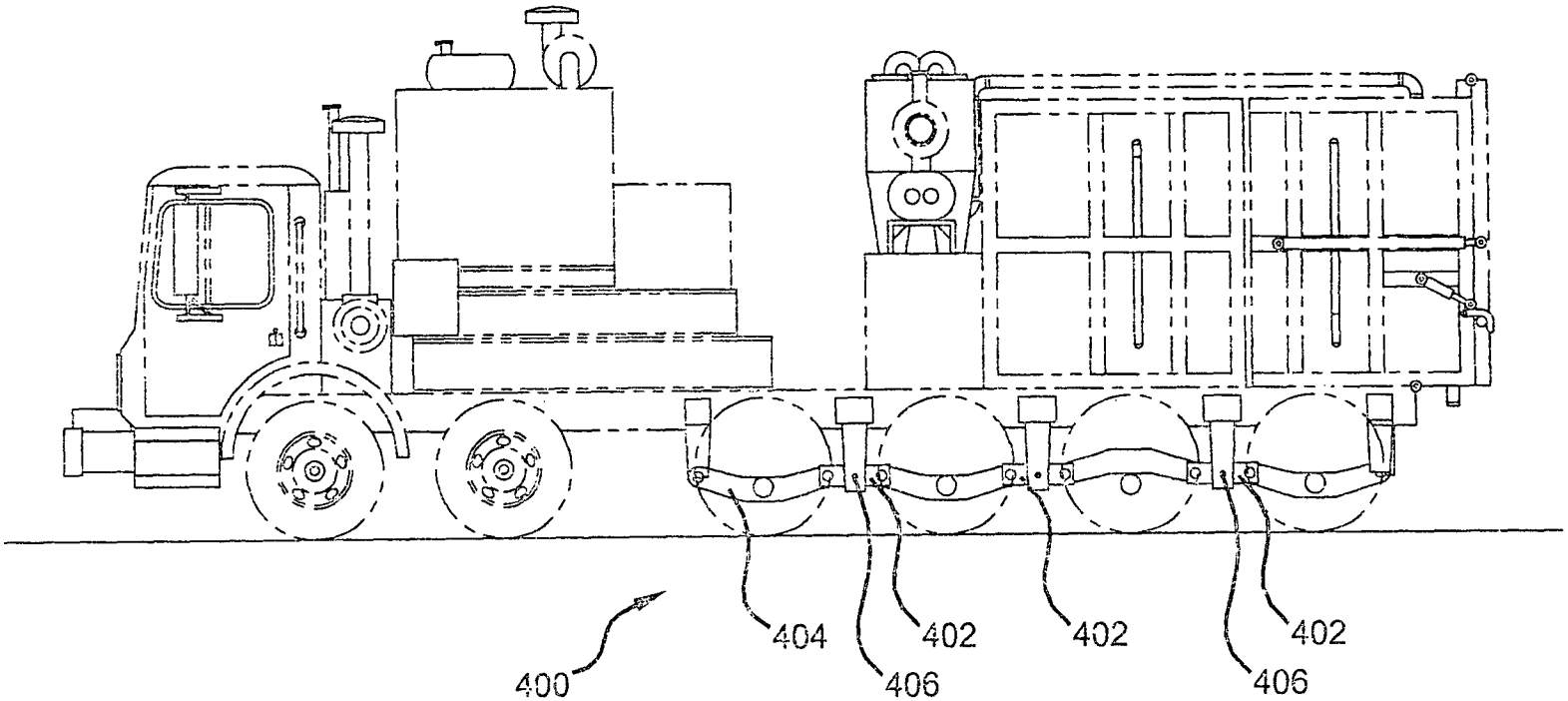
Figure 18:
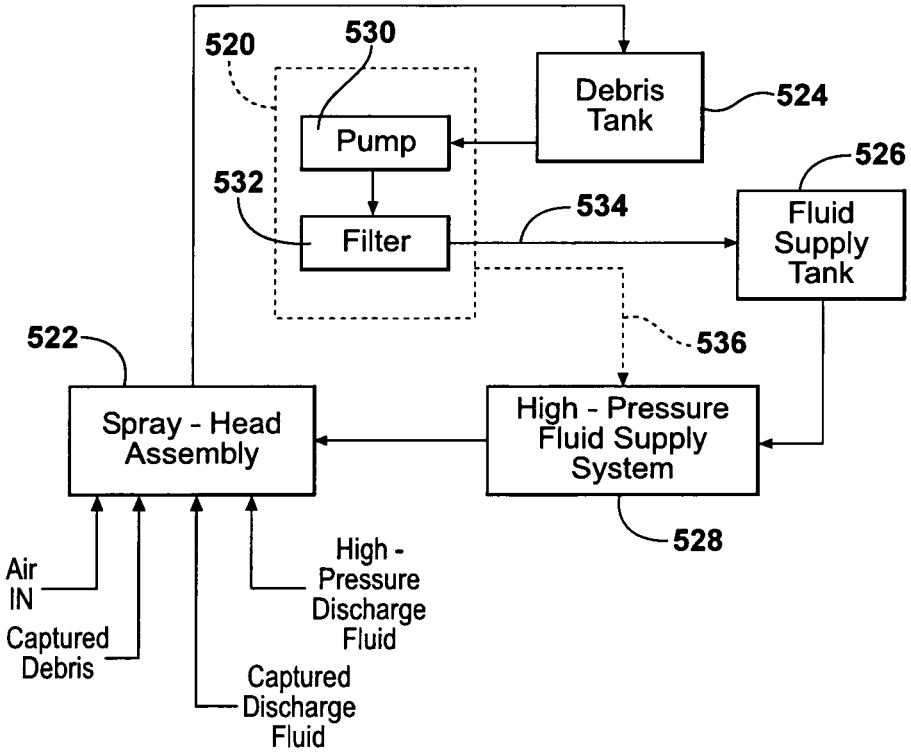
Figure 19:
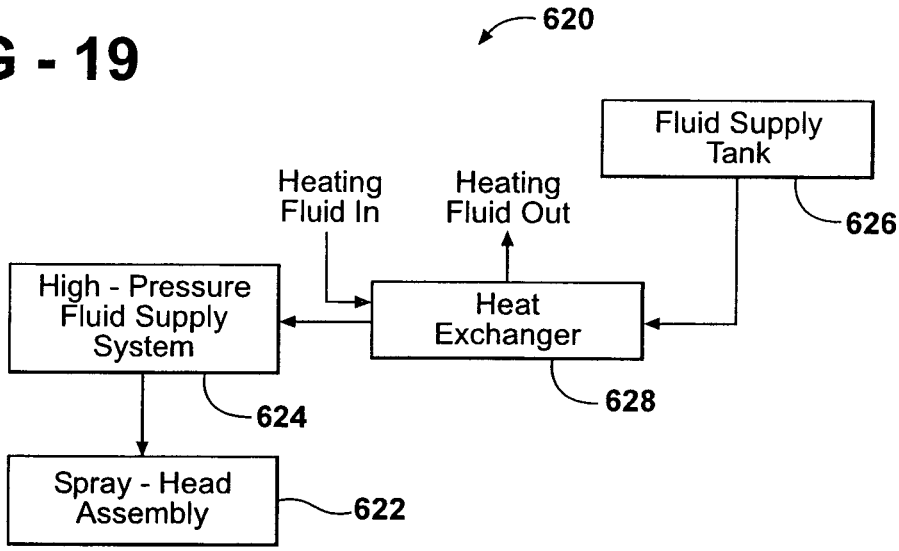
Figure 20:
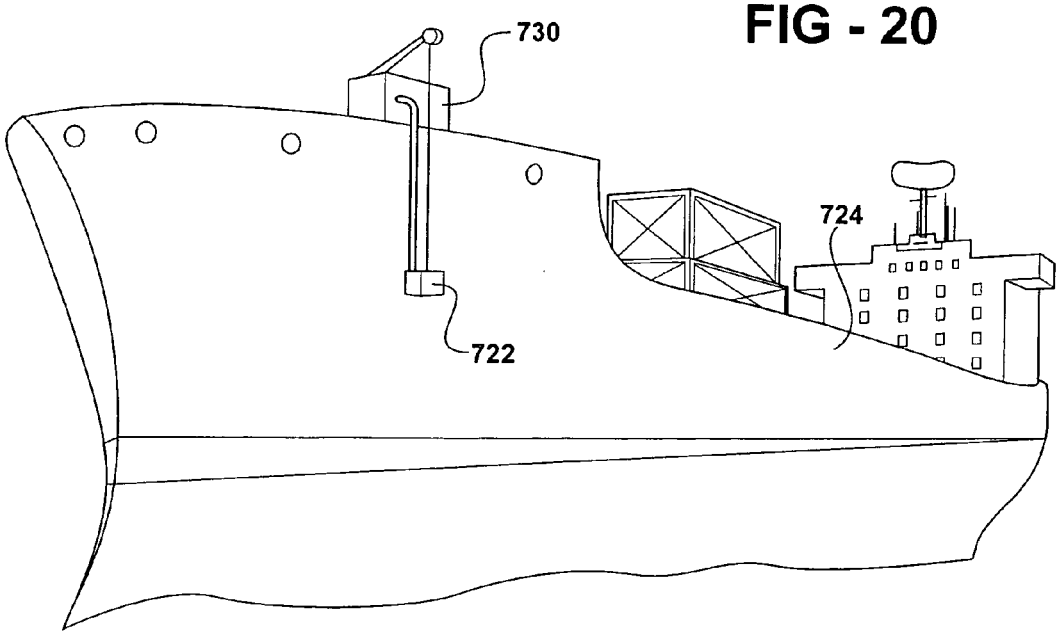
Figure 21:
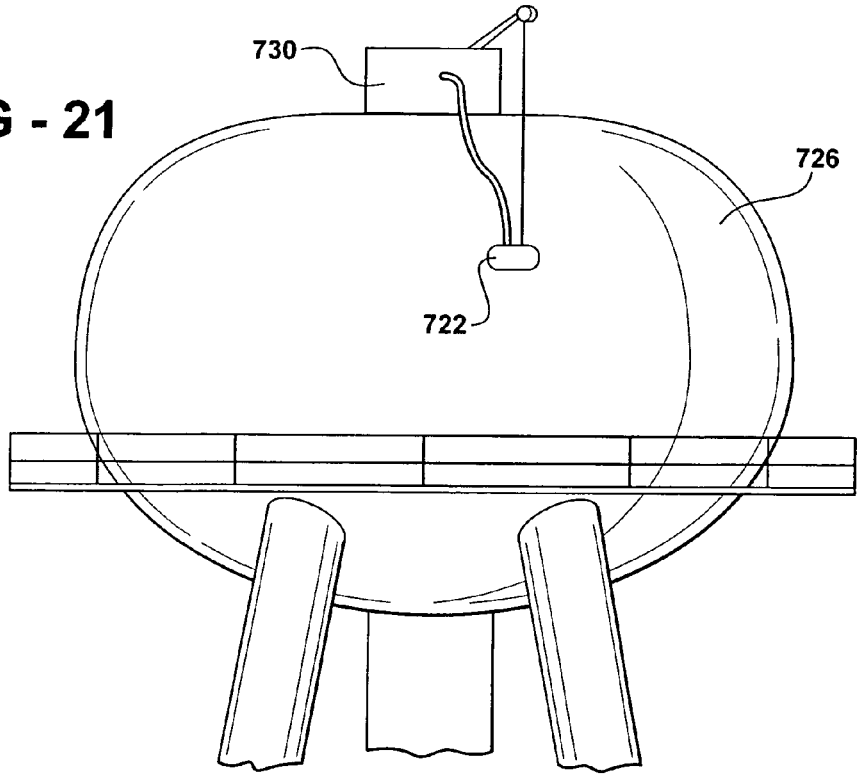
Figure 22:
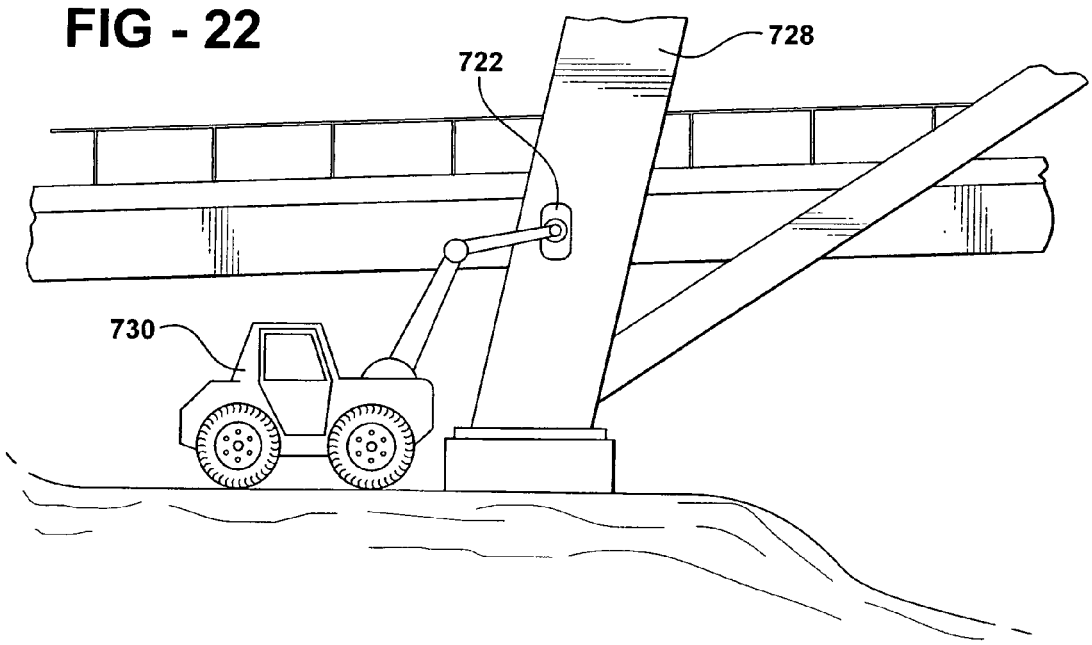

FIGS. 5A and B are fragmented side elevation views of the material-removal system of FIG. 1 showing the debris tank in an operational and a dumping position, respectively;

FIG. 6A is an end elevation view of the debris tank with the rear door removed;

FIG. 6B is a cross-sectional view of the debris tank along line 6B-6B of FIG. 5A;

FIGS. 7A and B are fragmented perspective views of the articulating-arm assembly and spray-head assembly of the material-removal system of FIG. 1 in an operational and non-operational position, respectively;

FIG. 8 is a perspective view of an exemplary spray-head assembly according to the present teachings;

FIG. 9 is a partial exploded view of portions of the spray-head assembly of FIG. 8;

FIG. 10 is a bottom plan view of the spray-head assembly of FIG. 8;

FIGS. 11A and B are perspective views of the gear-box assembly utilized in the spray-head assembly of FIG. 8;

FIG. 12 is a cross-sectional view along line 12-12 of FIG. 11A;

FIG. 13 is an enlarged fragmented view of the center fluid bar portion of the gear box assembly of FIG. 12;

FIG. 14 is a partially-cutaway perspective view of the lower shell of the gear-box assembly of FIG. 11;

FIG. 15 is an exploded view of the gear box assembly of FIG. 11;

FIG. 16 is a schematic representation of another exemplary spray-head assembly according to the present teachings;

FIG. 17 is a schematic representation of a suspension system that can be utilized on the mobile platform containing the material-removal system according to the present teachings;

FIG. 18 is a schematic representation of an exemplary recirculation system that can be utilized with a spray-head assembly according to the present teachings;

FIG. 19 is a schematic representation of an exemplary heated fluid supply system that can be utilized with a spray-head assembly according to the present teachings;

FIG. 20 is a representation of a spray-head assembly according to the present teachings removing material from a side of a ship;

FIG. 21 is a representation of a spray-head assembly according to the present teachings removing material from an exterior of a water tower; and FIG. 22 is a fragmented representation of a spray-head assembly according to the present teachings removing material from a bridge member.

DETAILED DESCRIPTION

The following description is merely exemplary in nature and is not intended to limit the present disclosure, application, or uses.

Referring to FIG. 1, a material-removal system 20 according to the present teachings is disposed on a mobile platform 22, such as a vehicle or truck. In the figures, mobile platform 22 is shown as a six-axle truck having a cab 24 and a frame 26. It should be appreciated that mobile platform 22 can take other forms. For example, mobile platform 22 can be a movable robotic mechanism, a cable system and other moveable devices and mechanisms. Material-removal system 20 can include a fluid-blasting, spray-head assembly 28 which can be coupled to vehicle 22 with an articulating-arm assembly 30. Spray-head assembly 28 can direct high-pressure fluid at a surface to remove debris therefrom, as described below. Material-removal system 20 can include a fluid-supply system 32 which can supply high-pressure fluid to spray-head assembly 28. Fluid-supply system 32 can be disposed on vehicle 22. Material-removal system 20 can also include a vacuum system 34 that can supply a vacuum to spray-head assembly 28. The vacuum can suck up the fluid discharged by spray-head assembly 28 and the debris generated thereby and deposit same in a debris tank 36, as described below. Vacuum system 34 can be disposed on vehicle 22.

Figure 2:
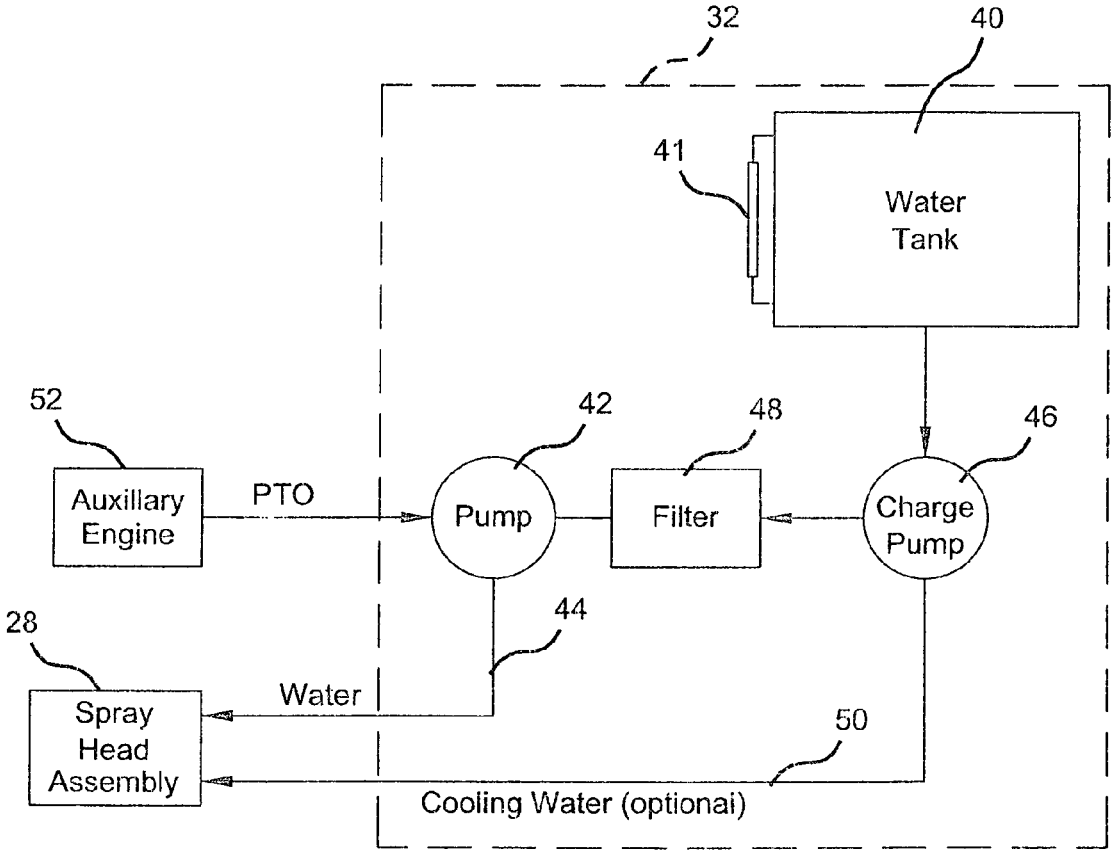
FIG. 2 is a schematic representation of a water system that can be utilized in the material-removal system of FIG. 1.

Referring now to FIGS. 1 and 2, details of fluid-supply system 32 are shown. Fluid-supply system 32 can include a storage tank 40 that supplies a fluid therein to a high-pressure pump 42. Storage tank 40 can have an external sight gage 41 to allow visual ascertation of the liquid level therein. High-pressure pump 42 is operable to supply high-pressure fluid, such as water, at a high pressure, such as 40,000 PSI + or −, to spray-head assembly 28 through a high-pressure fluid line 44. High-pressure pump 42 can supply high-pressure fluid to spray-head assembly 28 at a rate of about 0-24 gpm + or −. A suitable high-pressure pump 42 can take a variety of forms. One suitable pump includes Jet Stream Model No. 4200 available from Jet Stream of Houston, Tex. A charge pump 46 can be used to supply fluid from storage tank 40 to high-pressure pump 42. A filter 48 can filter the fluid flowing from charge pump 46 to high-pressure pump 42. Optionally, charge pump 46 can also supply a flow of cooling fluid to spray-head assembly 28, via an optional cooling line 50. High-pressure pump 42 can be driven by an auxiliary engine 52 mounted on vehicle 22. For example, auxiliary engine 52 can drive high-pressure pump 42 with a belt-and-pulley system. Auxiliary engine 52 can be a diesel engine. A PTO from the vehicle engine can also be used.

Figure 3:
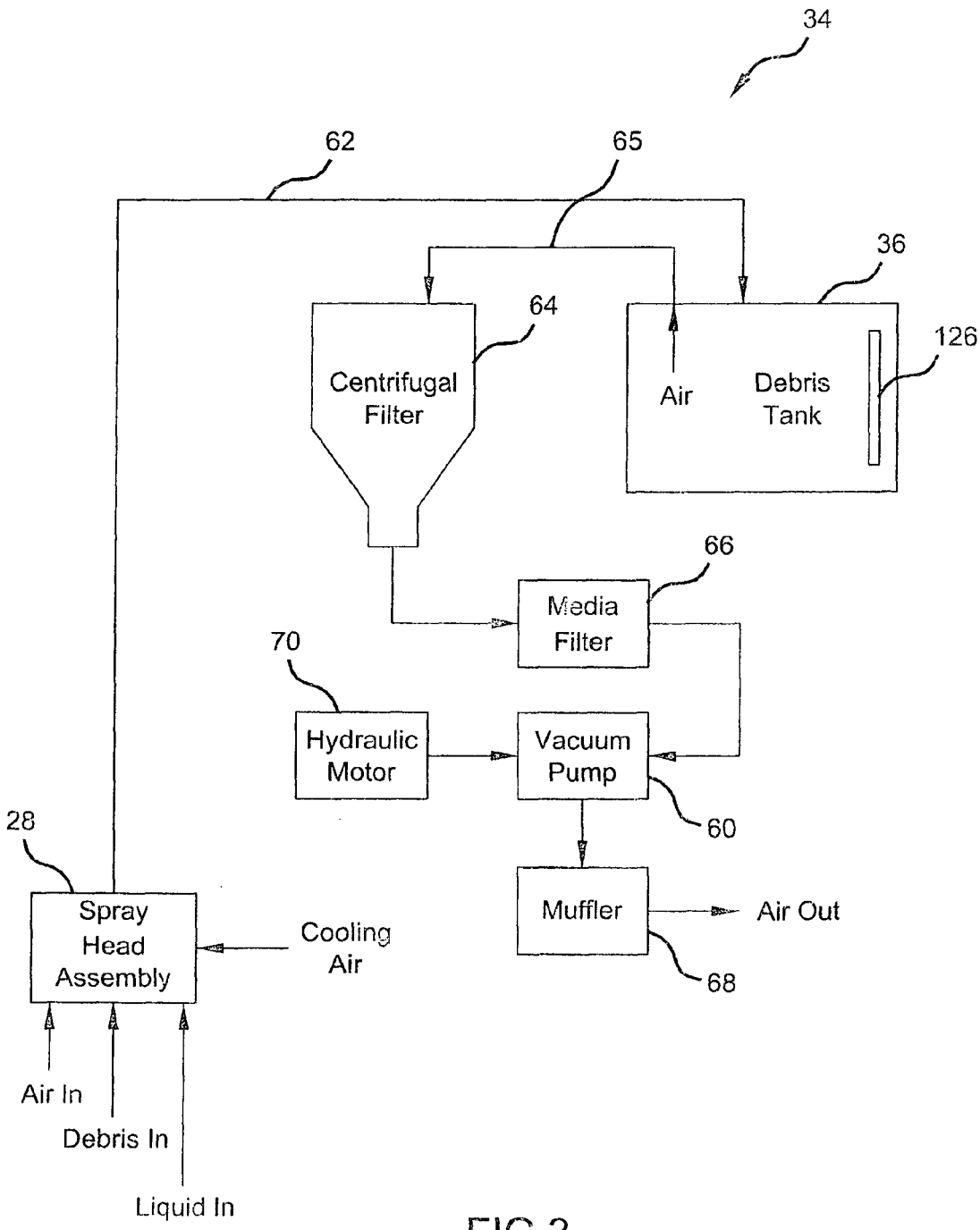
FIG. 3 is a schematic representation of a vacuum system that can be utilized in the material-removal system of FIG. 1.

Referring now to FIGS. 1 and 3, details of vacuum system 34 are shown. Vacuum system 34 can include a vacuum pump 60 that communicates with debris tank 36. Pump 60 can pull a vacuum on debris tank 36 to facilitate the collection of debris and liquid waste therein. Debris tank 36 communicates with spray-head assembly 28 through a vacuum hose 62. The vacuum created in debris tank 36 allows spray-head assembly 28 to suck in debris, air, and waste liquid and deposit the debris and waste liquid in debris tank 36 via vacuum hose 62. Debris tank 36 can communicate with one or more centrifugal filters 64 with a vacuum line 65. Centrifugal filters 64 and a media filter 66 can be utilized to remove particles in the air flowing from debris tank 36 to vacuum pump 60. Vacuum pump 60 can discharge the air to the environment through a muffler 68. Vacuum pump 60 can be driven by a hydraulic motor 70. Vacuum system 34 can pull a vacuum of about 10-16" Hg to facilitate the capturing of debris and waste liquid in debris tank 36. Suitable vacuum pumps include those available from Kaeser Compressors, Inc. of Fredricksburg, Va.

In operation, debris, liquid, and air are sucked into spray-head assembly 28 and flow through hose 62 and dump into debris tank 36. The air flows out of debris tank 36 and into centrifugal filter(s) 64 and subsequently into a media filter 66. The air leaves media filter 66 and flows through vacuum pump 60 and is discharged to the environment through muffler 68. Vacuum system 34 can also induce a flow of cooling air through spray-head assembly 28 that can flow across a gear box therein, as described below.

Figure 4:
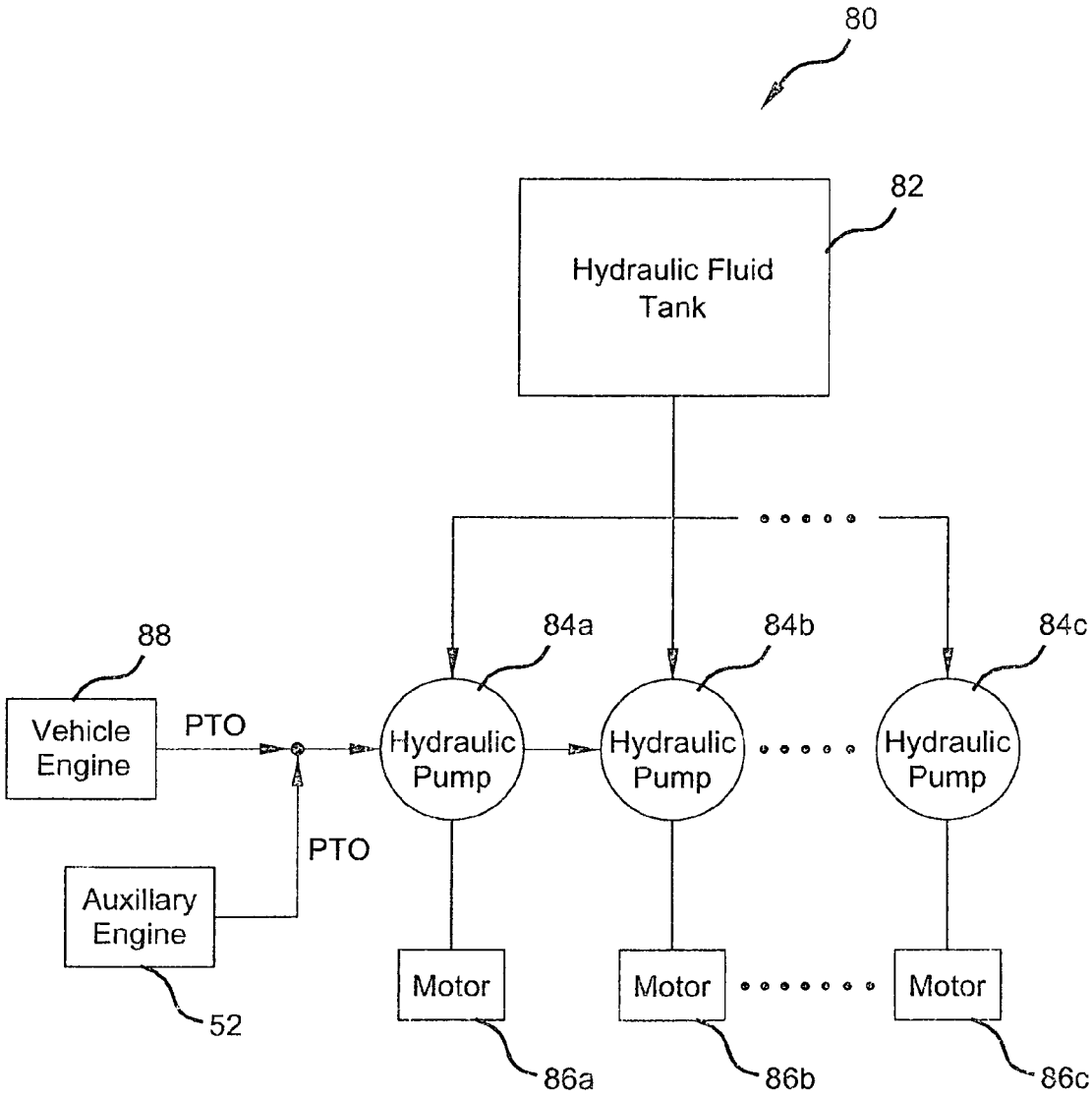
FIG. 4 is a schematic of a hydraulic system that can be utilized in the material-removal system of FIG. 1.

Referring now to FIGS. 1 and 4, details of a hydraulic system 80 that can be utilized in material-removal system 20 and on vehicle 22 is shown. Hydraulic system 80 can include a hydraulic fluid tank 82 that can supply hydraulic fluid to hydraulic pumps 84, such as pump $\mathbf{84}_a$, $\mathbf{84}_b$, and $\mathbf{84}_c$. Each hydraulic pump 84 can drive an associated hydraulic motor 86, such as hydraulic motors $\mathbf{86}_a$, $\mathbf{86}_b$, and $\mathbf{86}_c$. Hydraulic pumps 84 can be driven by auxiliary engine 52 or by the main vehicle engine 88. The number of hydraulic pumps 84 and associated hydraulic motors 86 will vary depending upon the needs of material-removal system 20 and vehicle 22. Additionally, which hydraulic pumps 84 are driven by auxiliary engine 52 and which are driven by vehicle engine 88 will also vary depending upon the power needs of the particular hydraulic pump and/or its location on vehicle 22. For example, hydraulic pump $\mathbf{84}_a$ and motor $\mathbf{86}_a$ can be associated with spray-head assembly 28 while hydraulic pump $\mathbf{84}_b$ and hydraulic motor $86_b$ can be associated with the hydrostatic drive of vehicle 22, and hydraulic pump $84_c$ and hydraulic motor 86, can be associated with articulating-arm assembly 30. It should be appreciated that the description of hydraulic pumps 84 and associated motors 86 is merely exemplary in nature and that the particular components of material-removal system 20 and mobile platform 22 will vary depending upon the design.

Figure 5B:
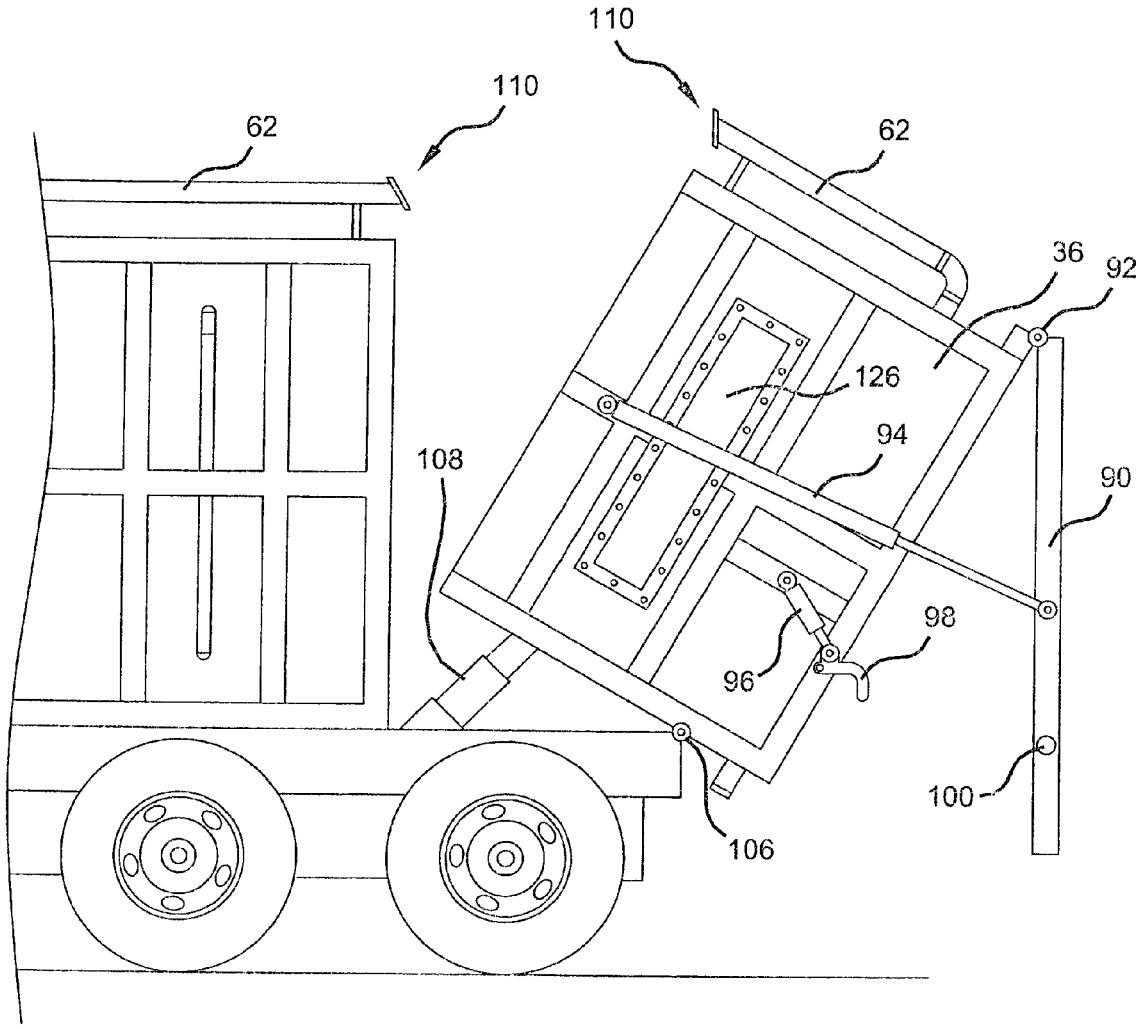

Referring now to FIG. 5, details of debris tank 36 are shown. Debris tank 36 includes a rear door 90 that pivots about an upper hinge 92. Door 90 can pivot between a closed position, as shown in FIG. 5A, to an open position, such as that shown in FIG. 5B. Door 90 can include one or more seals (not shown) to seal door 90 to debris tank 36 when closed and facilitate forming a vacuum therein. An extendible actuator 94, such as a hydraulic cylinder, can move between a retracted position, as shown in FIG. 5A, and an extended position, as shown in FIG. 5B, to open and close door 90. Another extendible actuator 96, such as a hydraulic cylinder, can move between an extended position, as shown in FIG. 5A, and a retracted position, such as that shown in FIG. 5B, to engage and disengage a locking arm 98 from a locking pin 100 on door 90. Debris tank 36 can be pivoted about a hinge 106 between an operational position, such as shown in FIG. 5A, and a dumping position, such as that shown in FIG. 5B. An actuator 108, such as a telescopic hydraulic arm, can be extended and retracted to move debris tank 36 between the positions shown in FIGS. 5A and 5B. Vacuum lines 62, 65 can each have a separable compression sealable joint 110 that allows lines 62, 65 to be separated during the movement of debris tank 36.

Referring now to FIGS. 6A and B, details of the internal configuration of debris tank 36 are shown. Debris tank 36 can have straight walls interconnected with curved corners. Alternatively, debris tank 36 can be more cylindrical in cross-section. Along the top surface of debris tank 36 is a float-check device 118 that includes a float 120 within a cage 122. Float 120 can be generally conical in shape and can include a tapering surface 123. Float 120 can float and will rise with the liquid level in debris tank 36. Float 120 can be bottom weighted to maintain the orientation shown within cage 122. As float 120 rises, tapering surface 123 can gradually restrict port 125 to restrict flow through vacuum line 65 (which is connected to port 125) as the liquid level increases. Float 120 can block port 125 when the liquid level is high enough. Thus, as the liquid level in debris tank 36 rises, float 120 can rise and restrict and/or plug port 125 thereby gradually restricting port 125 and preventing liquid from being sucked into vacuum pump 60.

Debris tank 36 includes an inlet port 124 through which debris, liquid, and air sucked up by spray-head assembly 28 can be received into the interior of debris tank 36. Vacuum hose 62 can be coupled to inlet 124. Debris tank 36 can include a sight window 126, as shown in FIGS. 1 and 5, which allows the liquid level within debris tank 36 to be visually ascertained. Debris tank 36 can include a filtration cage 128 that facilitates the separation of the liquid from the debris therein when draining the liquid from debris tank 36. Filtration cage 128 can include three vertically-extending walls 130 and a horizontal wall 132. The walls 130, 132 of filtration cage 128 are spaced inwardly apart from the vertically-extending side walls and horizontal bottom wall of debris tank 36. The top edges 131 and the rear edges 133 of walls 130 are sealed to the side walls and front walls of debris tank 36. A rear edge 135 of wall 132 is not sealed to the bottom wall of debris tank 36.

A space 134, as shown in FIG. 6B, thereby exists between the walls of debris tank 36 and walls 130, 132 of gage 128. The seal(s) on door 90 can seal against rear edges 133, 135 of walls 130,132 to prevent liquid and debris from passing therebetween and into space 134 without flowing through the perforations in walls 130, 132. The seal(s) on door 90 also seal against the rear edges of the walls of debris tank 36, as stated above. Walls 130, 132 are perforated to allow liquid to be drawn, with suction, therethrough. The perforations allow the liquid to be drawn therethrough while preventing debris larger than the size of the perforations from passing beyond filtration cage 128. Filtration media (not shown) can be affixed to walls 130, 132 to provide a greater level of filtration than possible with just perforated walls 130, 132. The filtration media can be sized to filter down to a desired particle size while allowing the liquid to be drawn therethrough and past walls 130, 132 through the perforations therein.

Debris tank 36 can include a plurality of openings in the bottom thereof to allow the removal of the liquid therefrom. A pair of discharge pipes 136 with valves 138 therein can be coupled to the ports on the bottom of debris tank 36. Valves 138 can be selectively opened to allow the liquid within debris tank 36 to be drained therefrom. During operation, valves 38 can be closed and debris tank 36 under vacuum by vacuum system 34. When material-removal system 20 is idle (i.e., vacuum system is not running), valves 138 can be opened to allow the liquid within space 134 to be drained therefrom.

In some applications, it may be necessary or desirable to remove liquid or liquid and debris from debris tank 36 during operation of material-removal system 20 (i.e., such as when vacuum system 34 is operational and debris tank 36 is under vacuum). Such possibilities may occur when it is permissible to discharge the liquid and/or debris captured within debris tank 36 directly to the environment. For this type of operation, however, debris tank 36 is under vacuum and removal from debris tank 36 can be difficult. The inventor has advantageously discovered that a peristaltic pump 140 can be utilized to remove liquid and debris from debris tank 36 during operation of material-removal system 20 and vacuum system 34. Peristaltic pump 140 can be coupled to one of the discharge valves 138 with a flexible hose 142. The associated valve 138 can be opened and peristaltic pump 140 can be operated to draw liquid and, if desired, debris from debris tank 36 while vacuum system 34 is operational thereby allowing debris tank 36 to remain under vacuum. Peristaltic pump 140 can discharge the liquid and debris removed from debris tank 36 to the environment through an outlet 144. Peristaltic pump 140 can be hydraulically driven. Suitable peristaltic pumps include Allweiler pumps available from Imo Pump of Monroe, N.C.

Removing liquid from debris tank 36 while traveling down the road can advantageously reduce down time and the time needed to recharge material removal system 20. Thus, in the event that the quantity of debris within debris tank 36 does not necessitate that the debris be physically removed from debris tank 36, when vehicle 22 arrives at a servicing station for service, it may be possible to only require the filling of fluid-storage tank 40 to enable further operation of material-removal system 20. That is, fluid-storage tank 40 can be filled at a much quicker rate than the waste fluid can be removed from debris tank 36. Thus, by removing the fluid from debris tank 36 while traveling down the road with peristaltic pump 140, the servicing time required to service material-removal system 20 can be significantly reduced thereby providing increased up time and greater revenue generation from material-removal system 20. Additionally, the pumping of liquid from debris tank 36 can draw the fluid through the filtration media affixed to walls 130, 132. Liquid can also be removed from debris tank 36 during the dumping operation. That is, when debris tank 36 is tilted upwardly, the liquid along with the debris therein can be removed by opening door 90. A suitable debris tank can be acquired from Flo Trend Systems of Houston, Tex. For example, Flo Trend Model No. VM-08-G/V debris tank can be utilized in material-removal system 20.

Figure 7B:
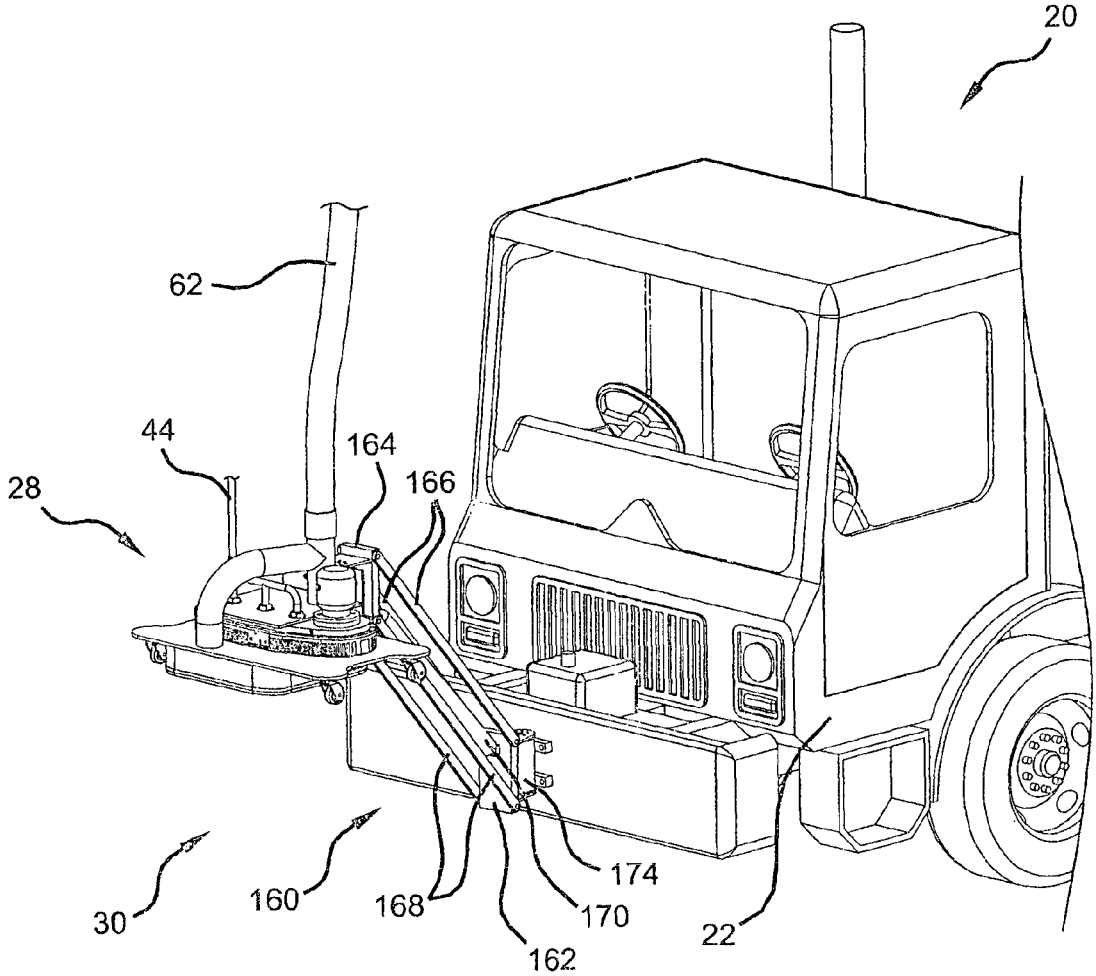

Referring now to FIGS. 7A and B, details of articulating-arm assembly 30 are shown. Articulating-arm assembly 30 can be a four-bar mechanism 160 having a base plate 162 and a spray-head plate 164. One end of a pair of upper arms 166 is pivotally coupled to base plate 162 while the other end of a pair of upper arms 166 is pivotally coupled to spray-head plate 164. Similarly, one end of a pair of lower arms 168 is pivotally coupled to a lower position on base plate 162 while the other end of a pair of lower arms 168 is pivotally coupled to a lower position on spray-head plate 164. Thus, base plate 162, upper arms 166, spray-head plate 164, and lower arms 168 form a four-bar mechanism that enables spray-head assembly 28 to be moved from an operational position, such as shown in FIG. 7A, to a non-operational position, such as that shown in FIG. 7B. To move four-bar mechanism 160 between the operational and non-operational positions, an extendible actuator 170, such as a hydraulic cylinder, can have one end coupled to base plate 162 while an opposite end of actuator 170 can be coupled to spray-head plate 164. Extension and retraction of actuator 170 can thereby move the four-bar mechanism and spray-head assembly 28 between the operational position and non-operational position.

Articulating-arm assembly 30 can also include a rotary actuator 174, such as a hydraulic actuator, that pivotally couples base plate 162 to the front bumper of vehicle 22. Rotary actuator 174 can rotate articulating-arm assembly 30 along about a vertically-extending axis. Articulating-arm assembly 30 can also include another rotary actuator 176, such as a hydraulic actuator, that can pivotally couple spray-head plate 164 to spray-head assembly 28. Rotary actuator 176 can thereby pivot spray-head assembly 28 relative to articulating-arm assembly 30 about a vertical axis.

Referring now to FIGS. 8-11, details of spray-head assembly 28 are shown. Spray-head assembly 28 includes a base plate 180 to which a gear-box assembly 182 is attached. Rotary actuator 176 of articulating-arm assembly 30 can be attached to base plate 180. Gear-box assembly 182 can include a plurality of shafts 184 that extend therethrough. Fluid bars 186 can be coupled to the ends of shafts 184 and used to direct pressurized fluid onto a surface to remove material therefrom, as described below. A shroud 190 can be attached to base plate 180 and form an enclosure for fluid bars 186. A flexible skirt 194 can be attached to shroud 190 and skim along the surface upon which spray-head assembly 28 is traveling. A plurality of wheels 198 can be coupled to base plate 180 and/or shroud. Wheels 198 can ride along the road or surface upon which spray-head assembly 28 is being utilized and can maintain spray-head assembly 28 a predetermined distance from the surface.

Gear-box assembly 182 can be driven by a hydraulic motor 210 to rotate fluid bars 186, as described below. Motor 210 can be mounted to gear-box assembly 182. Vacuum hose 62 is split and coupled to base plate 180 at multiple locations. In the material-removal system 20 shown, vacuum hose 62 is split into two lines 62*a*, 62*b* and can pass through openings 212, 214 in base plate 180 and be coupled to two vacuum ports 216, 218 on shroud. The attachment of vacuum hose 62 at these multiple locations facilitates the capture of the debris removed from the surface along with the fluid expelled by fluid bars 186, as described below. Additionally, the suction imparted on the cavity of shroud 190 facilitates the drawing of cooling air over gear-box assembly 182. Specifically, base plate 180 can have a plurality of ventilation openings 220 that align with a plurality of ventilation openings 222 in shroud 190. When vacuum hose 62 is sucking a vacuum on the cavity formed by shroud 190, along with air that enters cavity around skirt 194, air can also enter the cavity through ventilation openings 220, 222. The air entering ventilation openings 220, 222 passes between base plate 180 and gear-box assembly 182 thereby providing a flow of cooling or ventilating air across the surface of gear-box assembly 182. Ventilation openings 220, 222 can be disposed beneath gear-box assembly 182 at desired positions to encourage a desirable flow pattern across the surface of gear-box assembly 182. It should be appreciated that the location, size, and number of ventilation openings 220, 222 can vary depending upon the cooling needs of spray-head assembly 28 and gear-box assembly 182. High-pressure fluid line 44 is coupled to spray-head assembly 28 and communicates with each shaft 184 to supply high-pressure fluid to the associated fluid bar 186, as described below.

Referring now to FIG. 10, the bottom side of spray-head assembly 28 is shown. Each fluid bar 186 rotates along with rotation of shaft 184. As a result, each fluid bar 186 has a sweep area defined by broken line 230. The sweep area 230 of each fluid bar 186 can overlap the sweep area 230 of one or more other fluid bars 186, depending upon the arrangement of fluid bars 186 and shafts 184. As shown, fluid bars 186 can be arranged in a straight line and can be coplanar with one another. If desired, however, fluid bars 186 can be arranged in a non-linear configuration with or without overlapping sweep areas 230, and coplanar or non-coplanar, although all of the advantages may not be realized. With sweep areas 230 overlapping, the rotation of fluid bars 186 about their respective axis is coordinated to prevent fluid bars 186 from hitting or interfering with one another, as described below.

The sweep area 230 of each fluid bar 186 is representative of the area over which the associated fluid bar 186 can direct high-pressure fluid. The overlap of sweep areas 230 results in overlapping regions 234. Overlapping regions 234 allow for redundant coverage of the surface over which spray-head assembly 28 travels. Overlapping regions 234 may allow for quicker removal of the material or coating from the surface and may increase the rate at which vehicle 22 can be operated. Overlapping regions 234 may increase the efficiency of the removal operation and may reduce the costs associated with the removal. Additionally, the use of overlapping regions 234 can reduce the overall size of spray-head assembly 28 thereby facilitating the movement of spray-head assembly 28 over or into confined or restricted spaces. Additionally, articulating-arm assembly 30 can be adjusted and/or spray-head assembly 28 rotated, as described above, to change the spray pattern imparted upon the surface over which spray-head assembly 28 travels to accommodate wider or narrower areas of coverage of the surface.

Referring now to FIGS. 11-15, details of gear-box assembly 182 and fluid bars 186 are shown. Gear-box assembly 182 can include upper and lower housings 250, 252 that are secured together. Upper housing 250 can include a plurality of spray-shaft openings 254 and a drive opening 256. Lower housing 252 can include a plurality of spray-shaft openings 258 that are aligned with openings 254 of upper housing 250. Lower housing 252 does not include a drive opening therein as the shaft used to drive gear-box assembly 182 does not need to extend outwardly beyond lower housing 252. Lower housing 252 can include a plurality of fins 260 that extend therefrom. Fins 260 can facilitate the removal of heat from gear-box assembly 182. During operation of spray-head assembly 28, the suction caused by vacuum system 34 can draw air through ventilation openings 220, 222 in base plate 180 and shroud 190. The air can flow over fins 260 on its way to vacuum ports 216, 218. Thus, vacuum system 34 can facilitate the drawing of cooling air over fins 260 of gear-box assembly 182. Additional cooling can be provided through the use of an internal flow channel 264 in lower housing 252 (best seen in FIGS. 12 and 14). Flow channel 264 can extend along the periphery of lower housing 252 and can communicate with input and output channels 266, 268. Input channel 266 can be coupled to the optical cooling line 50 (FIG. 2) to supply a flow of cooling liquid through flow channel 264. The liquid can exit output channel 268 to be recovered by vacuum system 34. If desired, input and output channels 266, 268 can be coupled to the cooling system for vehicle engine 88 to provide a closed-loop cooling system to facilitate the removal of heat from gear-box assembly 182. Furthermore, the size, shape, and orientation of cooling fins 260 can vary from that shown to facilitate heat transfer and/or manufacture. Optionally, upper housing 250 can also be provided with fins (not shown) to facilitate the cooling of gear-box assembly 182, if desired.

Upper housing 252 can include grease channels 272 that communicate with spray openings 254 and drive opening 256. Grease channels 272 allow grease to be inserted into the bearings of gear-box assembly 182. Lower housing 252 can also include a grease channel (not shown) that allows grease to be inserted into a lower drive gear bearing of gear-box assembly 182.

Gear-box assembly 182 provides an indexing feature wherein the rotation of fluid bars 186 about their rotation axis is coordinated. The indexing feature prevents the rotation of fluid bars 186 from interfering with one another. The indexing feature of gear-box assembly 182 is provided through the intermeshing of gears associated with each fluid bar 186 and its associated shaft 184. As best seen in FIGS. 12 and 15, gear-box assembly 182 includes shafts 184 for each fluid bar 186. In the embodiment shown, three shafts 184 and three fluid bars 186 are utilized. It should be appreciated, however, that gear-box assembly 182 can be configured for as few as two shafts or more than three shafts, as desired. Each shaft 184 includes an upper portion 280 that extends upwardly out of upper housing 250. Upper portion 280 is configured to be attached to a fluid coupler that communicates with high-pressure fluid line 44. Each shaft 184 has a lower portion 282 that is received within a fluid bar 186 and communicates with the flow channels therein. A flow channel 284 extends between upper and lower portions 280, 282 of each shaft 184. Channel 284 allows high-pressure fluid to be supplied to fluid bars 186 through shafts 184. Each shaft 184 can also include first and second sets of teeth 286, 288 on an intermediate portion thereof. First set of teeth 286 engages with a coupler 292 that couples shaft 184 to an associated fluid bar 186. Coupler 292 includes an internal bore having teeth 294 therein. Teeth 294 engage with teeth 286 to rotationally fix coupler 292 to shaft 184. Coupler 292 can include a recessed channel 296 that can engage with opposing flats 298 on fluid bars 186. The engagement of channel 296 with flats 298 rotationally locks the fluid bar 186 to coupler 292 and, therefore, to the associated shaft 184.

Shafts 184 are disposed within gear-box assembly 182 with upper and lower portions 280, 282 extending outwardly beyond the respective upper and lower housings 250, 252. Each shaft 184 can be disposed within a channel extending through a hub 300 of a gear 302. Second set of teeth 288 can engage with a set of teeth within the channel of hub 300. The engagement of these teeth can rotationally lock shaft 184 to an associated gear 302. An upper bushing 304 can be disposed around the upper portion of the hub 300 and can engage with a shoulder of a spray opening 254 of upper housing 250. An upper bearing 306 can be disposed around the upper portion of hub 300 between bushing 304 and hub 300. Bushing 304 can include a fluid channel that communicates with the grease channel 272 in upper housing 250 to allow grease to be supplied to upper bearing 306. A lower bushing 307 can be disposed around the lower portion of the hub 300 and can engage with a shoulder of a spray opening 258. A lower bearing 308 can be disposed around the lower portion of hub 300 between bushing 307 and hub 300. Bushing 307 can include a fluid channel to allow grease to be supplied to lower bearing 308. The lower portion of hub 300 can extend through a plate 312 which can be secured to lower housing 252 coaxial with an associated spray opening 258. Plate 312 can include a grease channel 314 that allows grease to be supplied to lower bearing 308 through bushing 307. Shaft 184 is thereby axially constrained relative to upper and lower housings 250, 252. A shield 316 can be disposed on coupler 292 around shaft 184. Shield 316 can inhibit the flow of debris and blasting fluid from flowing upwardly and contacting plate 312 and the lower portion of hub 300.

Gears 302 have a set of teeth 318 that are intermeshed with one another. The intermeshing of teeth 318 of each gear 302 with another gear 302 rotationally links each shaft 184 and an associated fluid bar 186 with the other shafts 184 and fluid bars 186. As a result, the rotation of shafts 184 and the associated fluid bars 186 are coordinated so that fluid bars 186 do not interfere with or crash into one another during rotation.

Gear-box assembly 182 can also include a drive gear 330 with a set of teeth 332 thereon. Teeth 332 of drive gear 330 are intermeshed with teeth 318 in an adjacent gear 302. Rotation of drive gear 330 is translated into rotation of gears 302 through the intermeshing of the associated teeth 332, 318. Drive gear 380 includes a hub 333 with a set of internal teeth 336 therein. Teeth 336 can engage with the splines on a driveshaft of hydraulic-drive motor 210 to drive spray-head assembly 28. Optionally, a shear gear or coupler (not shown) can be disposed between the driveshaft of motor 210 and teeth 336 and can operate as a sacrificial part in the event of an overload condition, such as one of the fluid bars hitting an object. A bushing 338 can extend around the upper portion of hub 333 and can engage with a side wall of drive opening 256 of upper housing 250. An upper bearing 340 can be disposed between the upper portion of hub 333 and bushing 338. A lower bearing 342 can engage with a drive recess 334 in lower housing 252 which is arranged coaxially with drive opening 256 in upper housing 250. An upper plate 346 can be attached to the exterior surface of upper housing 250 coaxial with drive opening 256. Plate 346 can engage with bushing 338 to retain drive gear 330 between upper and lower housings 250, 252. Bushing 338 can include a channel that communicates with the grease channel 272 associated with drive opening 256 to facilitate the addition of grease to upper bearing 340. Similarly, lower housing 252 can include a grease channel (not shown) that facilitates the addition of grease to lower bearing 342.

Gear-box assembly 182 can be filled with an oil, such as a synthetic oil, to lubricate gears 302, 330 and their relative rotation. Lower housing 252 can include an input port 350 and an output port 352 that can, respectively, be used to add oil to and remove oil from gear-box assembly 182. Upper housing 250 can include a breather hole 354.

As best seen in FIG. 13, fluid bars 186 can be rectangular in cross section. Fluid bars 186 can include a generally-horizontally-extending flow channel 380 that communicates with flow channel 284 in the associated shaft 184. Fluid bars 186 can include a plurality of spray channels 382 that extend downwardly from flow channel 380. Spray channels 382 extend from flow channels 380 to nozzle cavities 384. Nozzle cavities 384 can receive a nozzle therein. The nozzles (not shown) can take a variety of forms and can provide a variety of spray patterns, as desired. The particular spray pattern chosen will depend upon the material to be removed and the surface upon which material-removal system 20 is operating. Fluid bars 186 can also include horizontally-extending nozzle cavities 386 on the ends of flow channels 380. The end nozzle cavities 386 can provide a fluid spray that helps clean the shroud of debris, if desired. Nozzle cavities 384, 386 can be plugged so that those nozzle cavities are not utilized to provide a fluid flow to remove material from the surface.

Spray channels 382 and the associated nozzle cavities 384 can be angled relative to the axis of rotation of shaft 184. For example, as shown in FIG. 13, spray channels 382 and nozzle cavities 384 can be angled outwardly as they extend downwardly. As a result, the spray pattern imparted upon the surface may provide an incident angle that is less than 90 degrees. By having the spray pattern hit the surface at a non-orthogonal angle, the fluid flow can facilitate the removal of material from the surface. For example, the glancing nature of the spray pattern can help lift the material from the surface. Spray channels 382 and nozzle cavities 384 can all have the same angular offset from the rotation axis or can vary from one another. Additionally, it should be appreciated that spray channels 382 and nozzle cavities 384 can also vary angularly into and out of the page in the view depicted in FIG. 13. That is, some of spray channels 382 and nozzle cavities 384 can be angled out of the page and some into the page in the view depicted in FIG. 13. Thus, as high-pressure fluid is supplied to fluid bars 186 and fluid bars rotate with the rotation of shafts 184, the high-pressure fluid can be directed to the surface at a glancing angle and the spray pattern rotated along the surface. The movement of spray-head assembly 28 along the surface directs the spray pattern along the surface and the removal of the material therefrom is facilitated.

Referring now to FIG. 10, the rotation of each fluid bar 184 is opposite that of the adjacent fluid bar. The intermeshing of gears 302 results in this opposite rotation. For example, as shown in FIG. 10, the two outermost fluid bars 186 can rotate counterclockwise while the center fluid bar 186 rotates clockwise. This opposite rotation of the adjacent fluid bars can advantageously direct the material removed from the surface toward a particular portion or portions of spray-head assembly 28. The vacuum ports 216, 218 can be advantageously provided on spray-head assembly 28 to coincide with the general area to which the debris is directed due to the relative rotations of fluid bars 186. For example, as shown in FIG. 10, the material removed from the surface can be directed toward one of the side walls of shroud 190, as indicated by arrows 392. In this embodiment, the debris is directed toward the front and back sides of shroud 190. Vacuum ports 216, 218 can be disposed in the area wherein debris arrows 392 converge to facilitate the capturing of the debris with the suction and the deposit in debris tank 36. Thus, the different relative rotations of fluid bars 186 can be utilized to direct the debris toward strategically-placed vacuum ports 216, 218. It should be appreciated, however, that the gearing can be arranged such that the fluid bars all rotate in a same direction, if desired.

Referring now to FIG. 17, a simplified representation of the suspension system 400 for vehicle 22 is shown. Suspension system 400 can transfer the loading on each of the axles so that a similar load is seen by each axle. The ability to shift the loading can be advantageous in that during operation of vehicle 22 and material-removal system 20, the load on vehicle 22 varies. That is, as the fluid within fluid-storage tank 40 flows through spray-head assembly 28, and is recovered and sucked into debris tank 36, the loading on the various axles will change. By equalizing the loading, more stable operation of vehicle 22 can be achieved along with the provision of not overloading any particular axle. Suspension system 400 can include a plurality of equalizer beams 402 connected between adjacent leaf-spring assemblies for adjacent axles. Suspension systems having such load-transferring capabilities are disclosed in U.S. Pat. No. 5,234,067, entitled "Tandem Axle Suspension for Vehicle," by Simard; U.S. Pat. No. 6,604,756, entitled "Tridem Axle Suspension," by Simard; and U.S. Pat. No. 6,382,659, entitled "Load Distributing Tandem Suspension Assembly," by Simard, the disclosures of which are incorporated herein by reference.

Referring now to FIG. 16, an alternate spray-head assembly 28' using a different drive system is shown. In this drive system, hydraulic motor 210' has an output shaft 412' that can have a sheave 414' thereon. A driveshaft 416' can be engaged with drive gear 330'. Driveshaft 416' can have a sheave 418' thereon. A belt 420' can interconnect sheaves 414', 418' to transfer rotation of output shaft 412' to driveshaft 416'. Drive gear 330' can engage with gears 302' to drive rotation of fluid bars 186'. In this manner, motor 210' can drive rotation of drive gear 330' and operation of spray-head assembly 28'. Belt 420' can function as the sacrificial component in the event that an overload condition occurs, such as when a fluid bar 186' encounters an obstacle.

Referring now to FIG. 18, an exemplary recirculation system 520 for use with a spray-head assembly 522 is shown. Recirculation system 520 enables captured discharged fluid to be reused (recirculated) to supply pressurized fluid to spray-head assembly 522. Recirculation system 520 takes captured discharge fluid from debris tank 524, removes particulate matter therefrom and supplies the fluid to fluid supply tank 526 for subsequent supplying to spray-head assembly 522 with high-pressure fluid supply system 528. High-pressure fluid supply system 528 can be similar to fluid-supply system 32 discussed above and shown in FIG. 2. Recirculation system 520 can include a pump 530 or other fluid displacement device that can draw captured discharge fluid from debris tank 524, which may be under vacuum. One or more filtering devices 532 removes particulate matter from the fluid removed from debris tank 524. The filtered fluid is routed to fluid supply tank 526 through line 534. Optionally, the filtered fluid may be routed directly to high-pressure fluid supply system 528, as indicated by fluid line 536 (shown in phantom).

The use of recirculation system 520 may allow the system using spray-head assembly 522 to operate for a longer continuous duration due to the increased quantity of fluid available to be supplied to spray-head assembly 522. Specifically, for a given fluid supply tank 526, if the captured discharged fluid is not recirculated the quantity of fluid that can be supplied to spray-head assembly 522 is limited to the capacity of fluid supply tank 526. By using recirculation system 520, the captured discharge fluid can be reused to increase the total quantity of fluid that can be supplied to spray-head assembly 522 without refilling. The increased duration can be effected by the efficiency of capturing discharged fluid and the ability to withdraw captured discharge fluid from debris tank 524. The longer continuous duration can allow for more efficient material removal and less down time.

It should be appreciated that recirculation system 520 can include more or less components than shown and can be implemented in a variety of mechanizations. For example, recirculation system 520 can include a combination of pumps, separators, filters, chemical treatment devices, catalysts, electrical current devices, and mechanical devices, all of various types, arranged in series and/or parallel. Preferably, the recirculated fluid has sufficient particulate matter removed to not adversely affect the nozzle life or life of other components of the spray-head assembly. For example, it is preferred that the recirculated fluid not contain particulates in excess of about 1.0 microns.

Referring now to FIG. 19, an exemplary heated fluid supply system 620 for use with a spray-head assembly 622 is shown. Heated fluid supply system is operable to heat the high-pressure fluid supplied to spray-head assembly 622. Heated fluid supply system can include a high-pressure fluid supply system 624, which can be similar to fluid-supply system 32 discussed above and shown in FIG. 2, which draws fluid from a fluid supply tank 626. The fluid supplied to spray-head assembly 622 flows through a heating device 628, such as a heat exchanger, disposed between fluid supply tank 626 and high-pressure fluid supply system 624. Within heating device 628, heat is transferred to the fluid flowing therethrough and supplied to high-pressure fluid supply system 624 and spray-head assembly 622. For example, when heating device is a heat exchanger, relatively hot heating fluid, such a hot coolant, can be routed through heat exchanger 628 in heat-conducting relation with the relatively cold blasting fluid being routed to spray-head assembly 622. The heating fluid transfers heat to the blasting fluid thereby increasing the temperature of the blasting fluid. The heating of the blasting fluid can enable the use of high-pressure fluid supply system 624 and spray-head assembly 622 in a lower temperature environment than when used without heated blasting fluid. It should be appreciated that heating device 628 can take other forms than the heat exchanger shown. For example, an electric heating device may be used. Furthermore, it should be appreciated that it may be possible to dispose heating device 628 in a different location along the supply route between fluid supply tank 626 and spray-head assembly 622. The use of heating device 628 can maintain the temperature of the blasting fluid (and the components through which the blasting fluid travels) above its freezing point and/or allow the temperature of the blasting fluid to be at a controlled temperature.

A spray-head assembly according to the present teachings can be used to remove material from a variety of hard surfaces. Such surfaces can be horizontal, vertical, inclined, flat, curved, undulating, irregular, and the like. The material being removed from the surface can include, but is not limited to, paint, coatings, graffiti and the like. Referring now to FIGS. 20-22, a spray head assembly 722 is shown being used to remove material from a ship 724, a water tower 726, and a bridge member 728, respectively. Spray-head assembly 722 can be moved along the surface of ship 724, water tower 726 and bridge member 728 by a driving mechanism 730. Driving mechanism 730 can take a variety of forms. For example, driving mechanism 730 can be a robotic arm, a mobile robot, a cable driven system, a track along which spray-head assembly 722 travels and the like. The driving mechanism 730 can be fixed in place and move spray-head assembly 722 along the surface or can be mobile to increase the surface over which spray-head assembly 722 can travel.

While spray-head assembly 722 in FIGS. 20-22 is shown as being used on exterior surfaces of ship 724, water tower 726 and bridge 728, it should be appreciated that a spray-head assembly according to the present teachings can be used on other surfaces. By way of non-limiting example, spray-head assemblies according to the present teachings can be used on interior surfaces, ceilings, walls, ship decks, roadways, floors, buildings and the like.

While the present invention has been described with reference to specific components, configurations, and arrangements, it should be appreciated that variations can be made to the embodiments disclosed without deviating from the teachings of the present invention. For example, while hydraulic-actuated cylinders, actuators, and motors shown as being used with material-removal system 20, it should be appreciated that other types of actuators, such as electric, pneumatic, steam, and the like, can also be employed. Additionally, the number of vacuum ports and their arrangements can also vary from that shown. Moreover, the number of fluid bars utilizing each spray-head assembly and their orientation can also vary from that shown. Additionally, while the fluid bars 186 are shown as overlapping one another during rotation, fluid bars 186 can be spaced apart such that fluid bars 186 do not overlap one another (i.e., cannot hit one another) and still be coordinated (indexed) with gear-box assembly 182. Furthermore, while wheels 198 are shown as maintaining spray-head assembly 28 a fixed distance from the surface upon which material is to be removed, other mechanizations for maintaining spray-head assembly 28 in a spaced relation from the surface from which material is to be removed can be used. Thus, such variations are not to be regarded as a deviation from the spirit and scope of the present teachings.

What is claimed is:

1. A material-removal system operable to remove material from a surface, the material-removal system comprising:

a plurality of fluid bars operable to direct a flow of high-pressure fluid toward a surface, said fluid bars being simultaneously rotatable about individual axes and overlapping one another during rotation, each of said plurality of fluid bars including a plurality of spray channels that are in fluid communication with spray nozzles provided a face of each fluid bar; and a drive mechanism operable to drive rotation of said fluid bars about said respective axes, said drive mechanism coordinating said rotation of said fluid bars such that rotation of said fluid bars is mechanically linked to one another, said drive mechanism includes a gear box assembly that comprises separate rotatable gears coupled to individual ones of the plurality of fluid bars and a drive gear, each of the separate rotatable gears and the drive gear being engaged together so that rotation of the drive gear effects rotation of the separate rotatable gears and the plurality of fluid bars so that adjacent ones of the plurality of fluid bars rotate in opposite directions, wherein each of the plurality of fluid bars has a center of rotation and a radius that extends from the center of rotation to opposite ends and a major portion of the radii of the fluid bars overlap one another when the plurality of fluid bars are rotated.

2. The material-removal system of claim 1, further comprising a recirculation system that captures fluid discharged by said plurality of fluid bars, removes particulate matter therefrom and supplies the captured fluid back to the plurality of fluid bars for reuse.

3. The material-removal system of claim 1, further comprising a heating device operable to heat fluid supplied to the plurality of fluid bars.

4. The material-removal system of claim 1, wherein each of the plurality of fluid bars consists of an elongated shape and includes more than two spray nozzles.

5. The material-removal system of claim 1, wherein the plurality of fluid bars comprises three or more.

* * * * *